US011237512B2

(12) United States Patent
Momiyama et al.

(10) Patent No.: US 11,237,512 B2
(45) Date of Patent: Feb. 1, 2022

(54) IMAGE FORMING SYSTEM AND IMAGE FORMING APPARATUS

(71) Applicant: CANON KABUSHIKI KAISHA, Tokyo (JP)

(72) Inventors: Daisuke Momiyama, Shizuoka (JP); Takashi Yano, Shizuoka (JP); Hidehiro Ushiozu, Shizuoka (JP); Masato Suzuki, Shizuoka (JP); Tomoki Fujikawa, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/113,136

(22) Filed: Dec. 7, 2020

(65) Prior Publication Data

US 2021/0181668 A1 Jun. 17, 2021

(30) Foreign Application Priority Data

Dec. 11, 2019 (JP) ..... JP2019-224025
Nov. 26, 2020 (JP) ..... JP2020-196337

(51) Int. Cl.
*G03G 15/00* (2006.01)

(52) U.S. Cl.
CPC ..... *G03G 15/6567* (2013.01); *G03G 15/6502* (2013.01); *G03G 15/6511* (2013.01);
(Continued)

(58) Field of Classification Search
CPC ..... G03G 15/6567; G03G 15/6502; G03G 15/6555; G03G 15/6511; G03G 15/6558;
(Continued)

(56) References Cited

U.S. PATENT DOCUMENTS

2015/0239695 A1* 8/2015 Noda ..... B65H 3/5261
271/265.01
2017/0267475 A1* 9/2017 Hirano ..... B65H 7/20
(Continued)

FOREIGN PATENT DOCUMENTS

EP 2345609 A2 * 7/2011 ..... B65H 7/06
JP 2010-030701 A 2/2010
(Continued)

*Primary Examiner* — Ryan D Walsh

(74) *Attorney, Agent, or Firm* — Carter, DeLuca & Farrell LLP

(57) ABSTRACT

An image forming apparatus comprises an accommodating unit that accommodates recording materials and has a regulating plate that regulates a trailing edge of the recording material in a feeding direction, detects a recording material fed from the accommodating unit, and measures time from a predetermined timing until a recording material is detected. An information processing apparatus receives time data obtained by a measuring unit from the image forming apparatus, classifies a plurality of time data received from a reception unit into a first group and a second group in accordance with a length of time, and determines using time data included in the first group and the time data included in the second group whether a position of the regulating plate is misaligned in relation to a reference position that corresponds to a size of the recording material accommodated on the accommodating unit.

20 Claims, 23 Drawing Sheets

(52) U.S. Cl.
CPC ..... *G03G 15/6555* (2013.01); *G03G 15/6558* (2013.01); *G03G 15/6564* (2013.01); *B65H 2405/112* (2013.01); *B65H 2801/06* (2013.01); *G03G 2215/00333* (2013.01); *G03G 2215/00341* (2013.01); *G03G 2215/00379* (2013.01); *G03G 2215/00383* (2013.01); *G03G 2215/00396* (2013.01); *G03G 2215/00721* (2013.01)

(58) Field of Classification Search
CPC ..... G03G 15/6564; G03G 2215/00383; G03G 2215/00396; G03G 2215/00721; G03G 2215/00333; G03G 2215/00379; G03G 2215/00341; B65H 2405/112; B65H 2801/06
See application file for complete search history.

(56) References Cited

U.S. PATENT DOCUMENTS

| | | | | |
|---|---|---|---|---|
| 2018/0246460 | A1* | 8/2018 | Sugano | G03G 15/6561 |
| 2018/0267451 | A1* | 9/2018 | Hirano | G03G 15/6558 |
| 2019/0023513 | A1* | 1/2019 | Hirano | G03G 15/6511 |
| 2021/0181653 | A1 | 6/2021 | Momiyama | |
| 2021/0182000 | A1* | 6/2021 | Kobayashi | G06F 3/1218 |

FOREIGN PATENT DOCUMENTS

| | | | |
|---|---|---|---|
| JP | 2015-105175 | A | 6/2015 |
| JP | 2015-212789 | A | 11/2015 |
| JP | 2017-170630 | A | 9/2017 |

* cited by examiner

FIG. 19A

DELAY SIDE DATA AFTER SORTING

| N-TH | DELAY SIDE DATA (ms) |
|---|---|
| 1 | 1460 |
| 2 | 1458 |
| 3 | 1458 |
| ... | ... |
| 23 (STATISTIC) | 1448 |
| 24 | 1448 |

FIG. 19B

EARLY ARRIVAL SIDE DATA AFTER SORTING

| N-TH | DELAY SIDE DATA (ms) |
|---|---|
| 1 | 1165 |
| 2 | 1165 |
| 3 | 1166 |
| ... | ... |
| 25 (STATISTIC) | 1170 |
| 26 | 1172 |

FIG. 19C

DELAY SIDE DATA AFTER SORTING

| N-TH | DELAY SIDE DATA (ms) |
|---|---|
| 1 | 1485 |
| 2 | 1488 |
| 3 | 1498 |
| ... | ... |
| 10 (STATISTIC) | 1520 |
| 11 | 1521 |

FIG. 19D

EARLY ARRIVAL SIDE DATA AFTER SORTING

| N-TH | DELAY SIDE DATA (ms) |
|---|---|
| 1 | 1165 |
| 2 | 1165 |
| 3 | 1166 |
| ... | ... |
| 10 (STATISTIC) | 1167 |
| 11 | 1167 |

PROBABILITY THAT TRAILING EDGE REGULATING PLATE IS MISALIGNED (%)

FIG. 20A

| NUMBER OF DATA | RANGE OF VALUE OF i | | | |
|---|---|---|---|---|
| | i<3 | 3≤i<5 | 5≤i<7 | 7≤i |
| 51~100 | 0 | 10 | 30 | 50 |
| 101~200 | 0 | 20 | 40 | 70 |
| 201~300 | 0 | 30 | 50 | 90 |
| 301~500 | 0 | 50 | 70 | 100 |
| 501~ | 0 | 60 | 80 | 100 |

DELAY SIDE DATA AFTER SORTING

FIG. 20B

| N-TH | DELAY SIDE DATA (ms) |
|---|---|
| 1 | 1490 |
| 2 | 1488 |
| 3 | 1488 |
| ... | ... |
| 23 (STATISTIC) | 1478 |
| 24 | 1475 |

EARLY ARRIVAL SIDE DATA AFTER SORTING

FIG. 20C

| N-TH | DELAY SIDE DATA (ms) |
|---|---|
| 1 | 1211 |
| 2 | 1212 |
| 3 | 1212 |
| ... | ... |
| 25 (STATISTIC) | 1260 |
| 26 | 1261 |

FIG. 21A

DELAY SIDE DATA AFTER SORTING

| N-TH | DELAY SIDE DATA (ms) |
|---|---|
| 1 | 1515 |
| 2 | 1518 |
| 3 | 1518 |
| ... | ... |
| 10 (STATISTIC) | 1550 |
| 11 | 1551 |

FIG. 21B

EARLY ARRIVAL SIDE DATA AFTER SORTING

| N-TH | DELAY SIDE DATA (ms) |
|---|---|
| 1 | 1241 |
| 2 | 1242 |
| 3 | 1242 |
| ... | ... |
| 10 (STATISTIC) | 1290 |
| 11 | 1291 |

FIG. 21C

PROBABILITY THAT SLIPPING IS OCCURRING (%)

| NUMBER OF DATA | RANGE OF VALUE OF i | | | |
|---|---|---|---|---|
| | i<3 | 3≤i<5 | 5≤i<7 | 7≤i |
| 51~100 | 0 | 10 | 30 | 50 |
| 101~200 | 0 | 20 | 40 | 70 |
| 201~300 | 0 | 30 | 50 | 90 |
| 301~500 | 0 | 50 | 70 | 100 |
| 501~ | 0 | 60 | 80 | 100 |

IMAGE FORMING SYSTEM AND IMAGE FORMING APPARATUS

BACKGROUND OF THE INVENTION

Field of the Invention

The present invention relates to an image forming system and an image forming apparatus.

Description of the Related Art

An image forming apparatus such as a copy machine or a printer comprises an accommodating unit on which a recording material (sheet) is accommodated and a feeding mechanism that conveys a sheet that is accommodated on the accommodating unit. When the recording material is conveyed by the feeding mechanism, jamming due to conveyance failure of the recording material occurs due to various causes. As an example, causes such as deterioration due to repetitive conveyance by a feeding roller, a slip caused by a recording material, and the like can be given.

Also, in the accommodating unit, there is a trailing edge regulating plate that performs positioning of a recording material by regulating the trailing edge of the recording material. In a case where a user does not correctly set this trailing edge regulating plate, conveyance failure of a recording material will occur. In order to prevent such conveyance failure of a recording material, in Japanese Patent Laid-Open No. 2015-212789, for example, a method is proposed for determining—in a case where the time (hereinafter, feeding time) it takes from the start of rotation of a feeding roller for conveying a recording material until the recording material reaches a sensor that is provided downstream of a conveyance path exceeds a predetermined threshold value—that the user did not correctly set the trailing edge regulating plate.

However, in the above conventional technique, even in a case where a recording material conveyance failure is caused by deterioration or slip of the feeding roller, there is a possibility that it may be erroneously determined to have been caused by the trailing edge regulating plate not being set correctly.

SUMMARY OF THE INVENTION

The present invention enables realization of a mechanism that determines the position of a regulating plate based on the conveyance state of a recording material.

One aspect of the present invention provides an image forming system comprising: an information processing apparatus and an image forming apparatus, wherein the image forming apparatus comprises an accommodating unit configured to accommodate a recording material and having a regulating plate for regulating a trailing edge of the recording material in a feeding direction; a feeding unit configured to feed a recording material accommodated in the accommodating unit; a detection unit configured to detect a recording material fed by the feeding unit; and a measuring unit configured to measure a time from a predetermined timing until the detection unit detects the recording material, and the information processing apparatus comprises a reception unit configured to receive time data obtained by the measuring unit from the image forming apparatus; a classification unit configured to classify a plurality of the time data received by the reception unit into a first group and a second group in accordance with a length of time; and a determination unit configured to determine, using the time data included in the first group and the time data included in the second group, whether or not a position of the regulating plate is misaligned in relation to a reference position which corresponds to a size of the recording material that is accommodated in the accommodating unit.

Another aspect of the present invention provides an image forming system comprising: an information processing apparatus and an image forming apparatus, wherein the image forming apparatus comprises an accommodating unit configured to accommodate a recording material; a feeding unit configured to feed a recording material accommodated in the accommodating unit; a detection unit configured to detect a recording material fed by the feeding unit; and a measuring unit configured to measure a time from a predetermined timing until the detection unit detects the recording material, and the information processing apparatus comprises a reception unit configured to receive time data obtained by the measuring unit from the image forming apparatus; a classification unit configured to classify a plurality of the time data that is received by the reception unit into a first group and a second group in accordance with a length of time; and a determination unit configured to, using the time data included in the first group and the time data included in the second group, determine whether recording material slipping is caused by the feeding unit.

Still another aspect of the present invention provides an image forming apparatus, comprising: an accommodating unit configured to accommodate a recording material and having a regulating plate regulating a trailing edge of the recording material in a feeding direction; a feeding unit configured to feed a recording material accommodated in the accommodating unit; a detection unit configured to detect a recording material fed by the feeding unit; and a measuring unit configured to measure a time from a predetermined timing until the detection unit detects the recording material, and a classification unit configured to classify a plurality of the time data obtained by the measuring unit into a first group and a second group in accordance with a length of time; and a determination unit configured to determine, using the time data included in the first group and the time data included in the second group, whether or not a position of the regulating plate is misaligned in relation to a reference position which corresponds to a size of the recording material that is accommodated in the accommodating unit.

Further features of the present invention will be apparent from the following description of exemplary embodiments with reference to the attached drawings.

BRIEF DESCRIPTION OF THE DRAWINGS

The accompanying drawings, which are incorporated into and constitute a part of the specification, illustrate embodiments of the invention and, together with the description, serve to explain the principles of the invention.

FIG. 19A to FIG. 19D are views illustrating examples for obtaining statistics of delay data on a delay side and an early arrival side after feeding time data is sorted.

FIG. 20A to FIG. 20C are views illustrating an example of a table for obtaining the probability of a misalignment in the trailing edge regulating plate and examples for obtaining statistics of delay data on the delay side and the early arrival side after the feeding time data is sorted.

FIG. 21A to FIG. 21C are views illustrating an example of a table for obtaining the probability of the occurrence of slipping and examples for obtaining statistics of delay data on the delay side and the early arrival side after the feeding time data is sorted.

DESCRIPTION OF THE EMBODIMENTS

Figure 1:
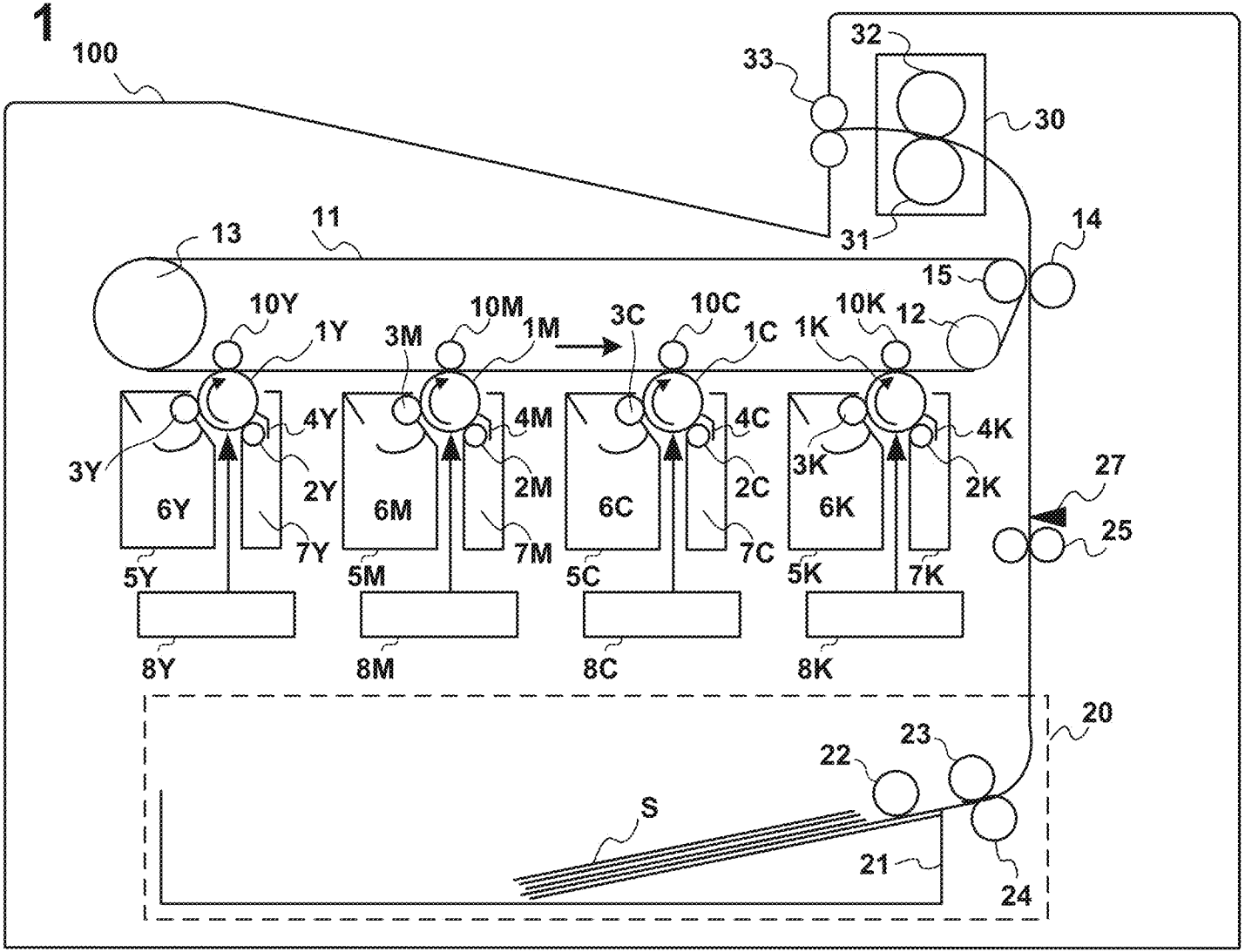
FIG. 1 is a schematic configuration diagram of an image forming apparatus in which a plurality of image forming units are arranged in parallel by adopting an intermediate transfer belt according to a first embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

FIG. 1 is a schematic configuration diagram of an image forming apparatus 100 in which a plurality of image forming units are arranged in parallel by adopting an intermediate transfer belt according to a first embodiment.

The image forming apparatus 100 is a tandem color laser beam printer and can form (print) a color image by superimposing four colors of toners—yellow (Y), magenta (M), cyan (C), and black (K). In FIG. 1, a configuration of image forming units corresponding to each color is indicated by adding subscripts Y. M. C, and K to reference numbers. Note that in the following description, particularly in the description of members for which yellow, magenta, cyan, and black do not need to be distinguished, for the sake of descriptive convenience, the subscripts Y, M, C, and K of the reference numerals will be omitted.

Each process cartridge 5 has a toner container 6, a photosensitive drum 1 which is an image carrier, a charging roller 2, a developing roller 3, a drum cleaning blade 4, and a waste toner container 7. A laser unit 8 is disposed below the process cartridge 5, and the laser unit 8 performs exposure in relation to the photosensitive drum 1 based on an image signal. On the photosensitive drum 1, after the surface of the charging roller 2 is charged to a potential having a predetermined negative polarity by applying a voltage having a predetermined negative polarity to the charging roller 2, an electrostatic latent image that corresponds to each color is formed by the laser unit 8. A reversal development of this electrostatic latent image is performed by applying a voltage of a predetermined negative polarity to the developing roller 3, and Y, M, C, and K toner images are formed on their respective photosensitive drums 1. Note that the toner used in the first embodiment is negatively charged.

An intermediate transfer member unit has an intermediate transfer member 11, a drive roller 12, a tension roller 13, and an opposing roller 15. Also, a primary transfer roller 10 is disposed inside the intermediate transfer member 11 facing the photosensitive drum 1, and a transfer voltage is applied to the primary transfer roller 10 by a voltage application unit (not shown). A toner image that is formed on the photosensitive drum 1 is primary-transferred onto the intermediate transfer member 11 by rotating each photosensitive drum and the intermediate transfer member 11 in the direction of the arrow and then applying a positive voltage to the primary transfer roller 10. The toner images on the photosensitive drums 1 are primary-transferred onto the intermediate transfer member 11 in the order of Y, M, C, and K and then are conveyed to a secondary transfer roller 14 in a state in which the toner images of the four colors are overlapped.

A feeding mechanism 20 has a feeding roller 22 for feeding the recording material S from the inside of a feeding cassette 21 on which the sheet-shaped recording material S is accommodated and stored, a conveyance roller 23 for conveying the fed recording material S, and a separation roller 24 for separating and conveying the recording material S one by one. Then, the recording material S that is conveyed from the feeding mechanism 20 is conveyed to the secondary transfer roller 14 by a registration roller pair 25. In order to transfer the toner image from the intermediate transfer member 11 to the recording material S, a voltage of positive polarity is applied to the secondary transfer roller 14. As a result, the toner image on the intermediate transfer member 11 is secondarily transferred onto the conveyed recording material S. Then, the recording material S to which the toner image is transferred is conveyed to a fixing device 30 and is heated and pressurized by a fixing film 31 and a pressure roller 32 of the fixing device 30, and the toner image is fixed to the surface of the recording material S. Then, the recording material S on which the image is fixed is discharged by a discharge roller pair 33.

At this time, the image forming apparatus determines whether or not conveyance failure such as an early arrival, a delay, or a jam of the recording material has occurred by using a conveyance path sensor 27. In a case where it is determined that conveyance failure has occurred, display for notifying that conveyance failure has occurred in the display unit (not shown) is performed. Also, a method for resolving conveyance failure and the like is displayed as necessary.

Next, the feeding mechanism 20 according to the first embodiment will be described in detail with reference to FIG. 2.

FIG. 2 is a schematic cross-sectional view describing a feeding operation in the image forming apparatus 100 according to the first embodiment.

Figure 2A:
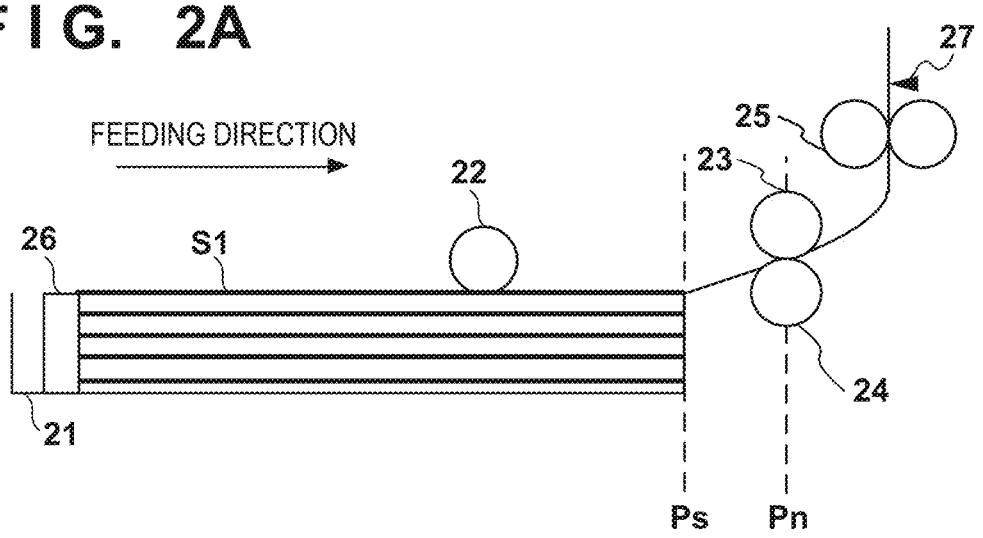
FIG. 2A to FIG. 2C are schematic cross-sectional views describing a feeding operation in the image forming apparatus according to the first embodiment.

FIG. 2A is a cross-sectional view of the feeding mechanism at a timing when a recording material S1 that is stored in the feeding cassette 21 and positioned at the top is fed. The trailing edge of the recording material S1 in the feeding cassette 21 is regulated and positioned by a trailing edge regulating plate 26 in the feeding cassette 21, and the leading edge at the time of feeding the recording material S1 is at a position indicated by Ps. When a feeding operation is started, the feeding roller 22 (feeding member) and the conveyance roller 23 (conveyance member) each rotate, and the recording material S1 starts to move in the right direction (feeding direction) in FIG. 2A by the friction between the feeding roller 22 and the recording material S1. Then, the recording material S reaches a separate nip Pn formed by the conveyance roller 23 and the separation roller 24 (separation member).

Figure 2B:
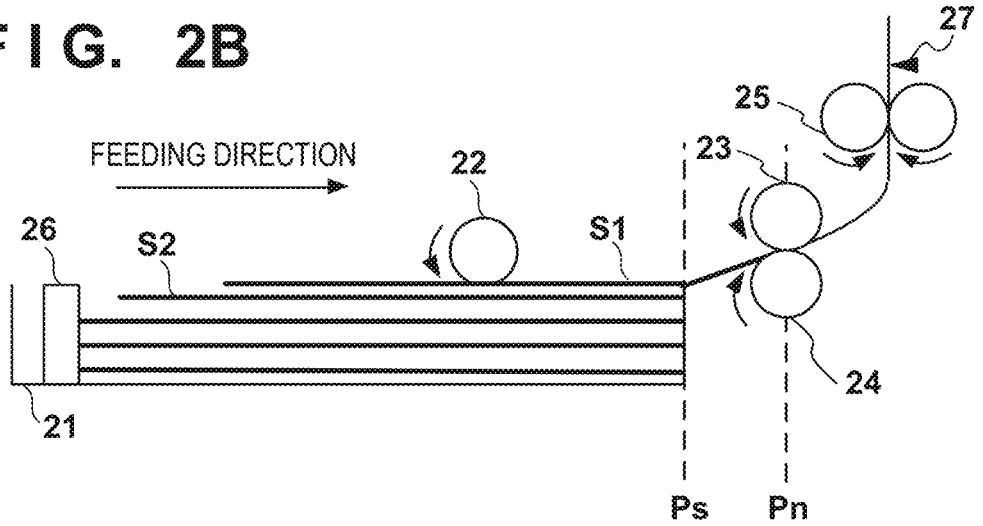

At this time, as illustrated in FIG. 2B, frictional force also occurs between recording materials S1 and S2, and the recording material S2 may also move. This separate nip Pn, when two or more recording materials S1 and S2 are conveyed to the separate nip Pn by the rotation of the feeding roller 22, has a function of separating the recording material S2 and then sending only one recording material S1 downstream. A torque limiter (not shown) is connected to the separation roller 24, and torque as a resistance force is applied in a direction opposite to the conveyance direction of the recording material S1. This torque is set so that when there is only one recording material S in the separate nip Pn, the separation roller 24 rotates following the conveyance roller 23, but when two recording materials S enter the separate nip Pn, the separation roller 24 stops. Accordingly, recording materials can be conveyed downstream one by one by the separate nip Pn.

Figure 2C:
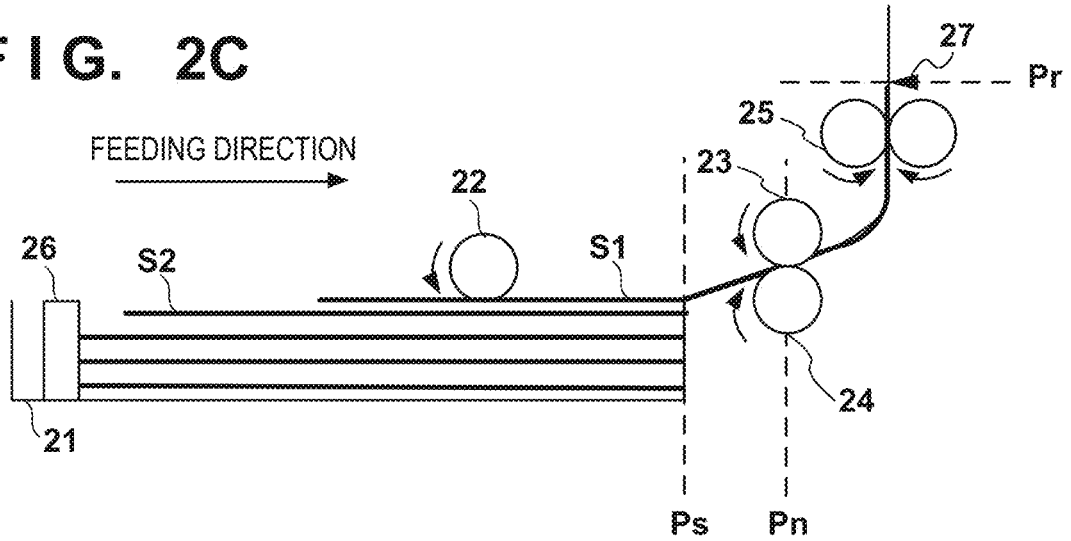

Then, when the feeding roller 22 and the conveyance roller 23 further continue to rotate, the recording material S1 passes through the registration roller pair 25, and the leading edge of the recording material S1 reaches a position Pr where the leading edge is detected by the conveyance path sensor 27 as illustrated in FIG. 2C. The time from the start of the feeding operation until the recording material S1 reaches the conveyance path sensor 27 is the feeding time.

Figure 3A:
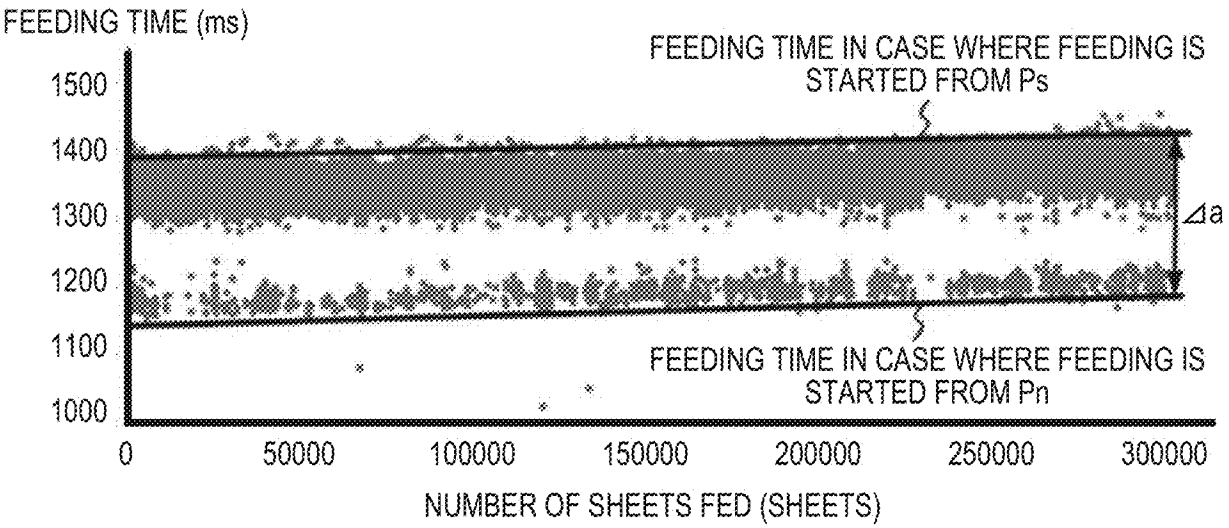
FIG. 3A to FIG. 3B are views illustrating examples of the transition of feeding times when an operation for feeding a recording material S is repeated in a conveyance mechanism according to the first embodiment.

FIG. 3A is a view illustrating an example of the transition of feeding times when an operation for feeding a recording material S is repeated in a conveyance mechanism as illustrated in FIG. 2.

As illustrated in FIG. 3A, when the feeding operation of the recording material S is repeated, the feeding time tends to lengthen in general. This is because, by repeating the feeding operation of the recording material, the feeding roller 22 is abraded and the frictional force between the feeding roller 22 and the recording material decreases. As described above, when feeding is started from the separate nip Pn, the feeding time is shorter, and when feeding is started from the position Ps of the leading edge of the recording material in the feeding cassette 21, the feeding time is longer.

Also, even if the feeding operation is repeatedly conducted, if the trailing edge regulating plate 26 is correctly set, the difference between the feeding times of when the sheet is fed from Ps and of when the sheet is fed from Pn (Aa in FIG. 3A) will be constant at all times.

Figure 3B:
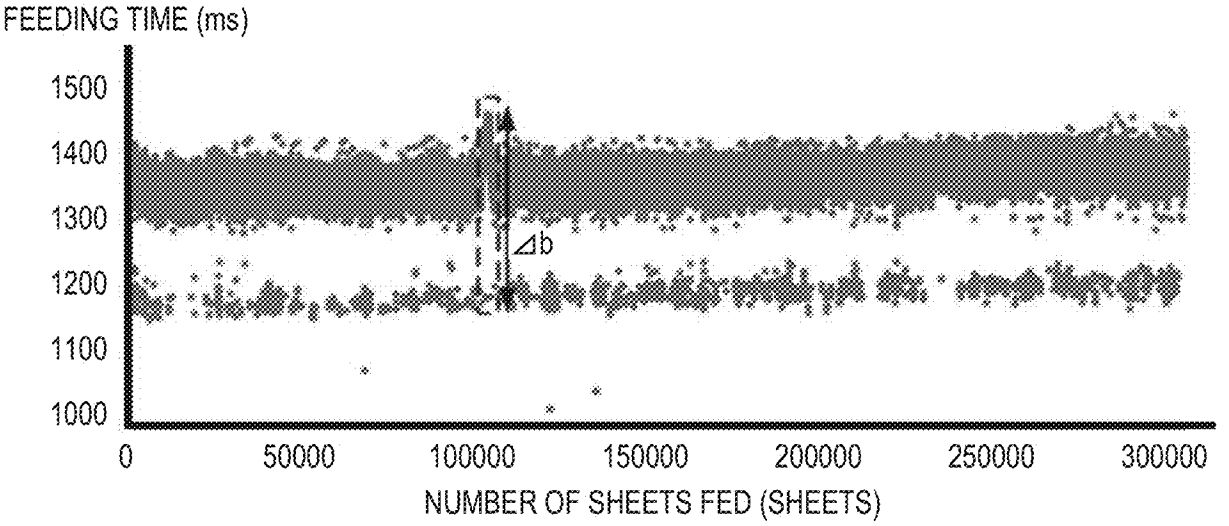

Meanwhile, the dotted-line frame in FIG. 3B is data of when the position of the trailing edge regulating plate 26 is misaligned, from the original position (a set position, also referred to as a reference position), in the direction opposite to the conveyance direction of the recording material. In a case where the trailing edge regulating plate 26 is misaligned in the direction opposite to the conveyance direction, all delay side data is shifted to the delayed side and there is no change in the early arrival side data (Δb in FIG. 3B). Therefore, the relationship between Δa and Δb is $\Delta a < \Delta b$.

Here, the reason why the delay side data is delayed is that the conveyance distance of the recording material is lengthened due to feeding being started in a state in which the leading edge position of a recording material is misaligned further to the trailing edge regulating plate 26 side than Ps. Also, the reason why there is no change in the early arrival side data is that there is no change in the fact that the positional misalignment of the trailing edge regulating plate 26 generates frictional force between recording materials thereby moving the subsequent recording material to Pn.

Figure 4:
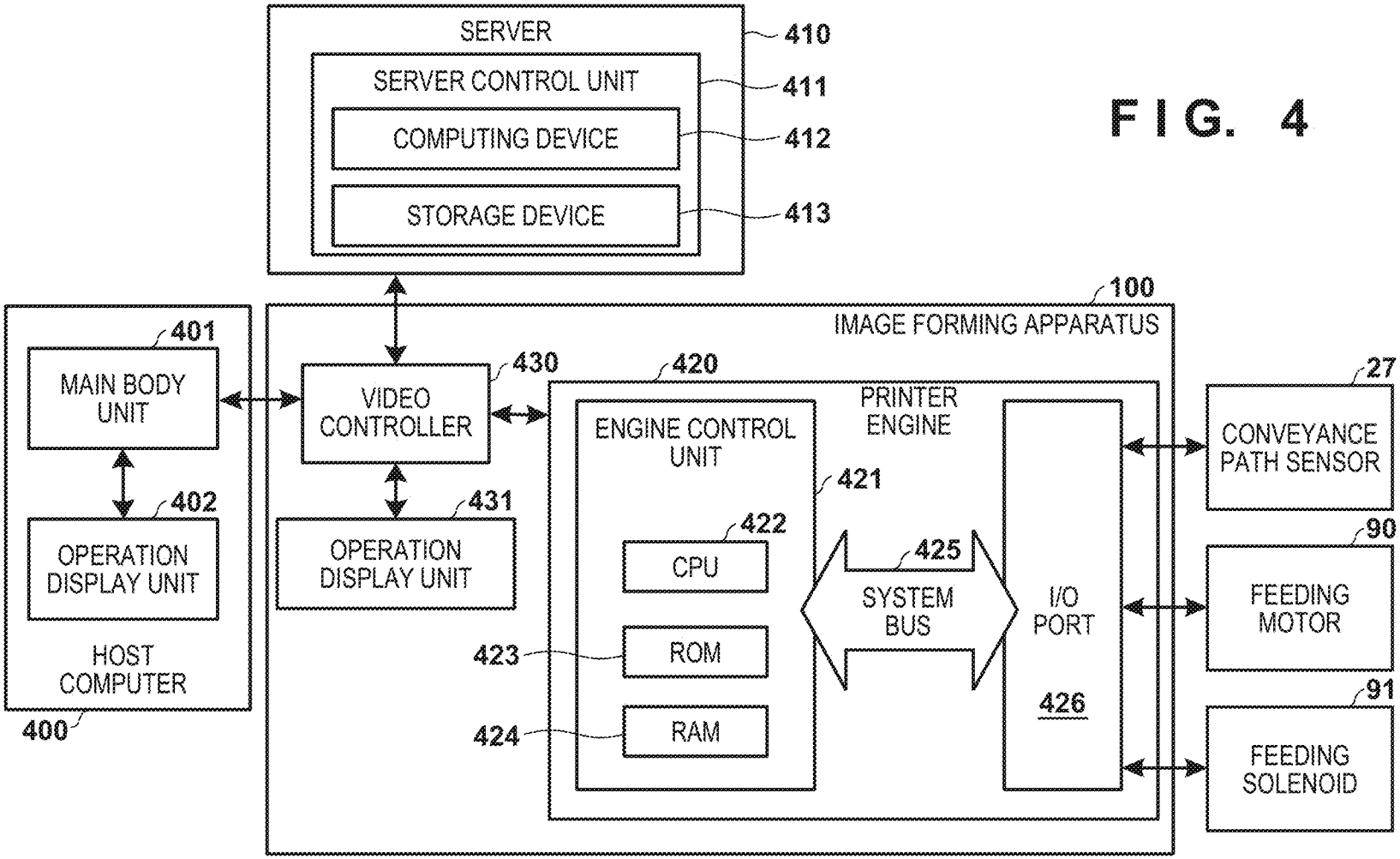
FIG. 4 is a block diagram describing a hardware configuration of the image forming apparatus and a configuration of an image forming system that includes the image forming apparatus according to the first embodiment.

FIG. 4 is a block diagram describing a hardware configuration of the image forming apparatus 100 and a configuration of an image forming system that includes the image forming apparatus 100 according to the first embodiment. This system includes a host computer 400, the image forming apparatus 100, and a server (information processing apparatus) 410. The host computer 400 has a main body unit 401 for instructing the image forming apparatus 100 to print via a network and an operation display unit 402 for accepting an operation of the user and performing display that is related to the user. Here, the operation display unit 402 that the host computer 400 has includes a display having a touch panel function, a keyboard, a pointing device, and the like, which are not shown.

The image forming apparatus 100 has a video controller 430, an operation display unit 431, and a printer engine 420. The operation display unit 431 that the image forming apparatus 100 has includes an operation panel, an operation button, and the like, which are not shown. The video controller 430 transmits print data and a print instruction that were transmitted from the host computer 400 to the printer engine 420. The printer engine 420 has an engine control unit 421 including a CPU 422, a ROM 423, and a RAM (memory) 424, a system bus 425, and an IO port 426. The CPU 422 executes a program by deploying the program and various data stored in the ROM 423 in the RAM 424 and using the RAM 424 as a work area. The configuration elements described above can access the IO port 426 via the system bus 425 which enables access in both directions. The conveyance path sensor 27, a feeding motor 90, a feeding solenoid 91, and the like are connected to the IO port 426. The CPU 422 controls these devices via the IO port 426. Note that the devices connected to the IO port 426 are not limited to the configuration in FIG. 4.

A server 410 has a server control unit 411 including a computing device 412 and a storage device 413 and is connected to the image forming apparatus 100 via a network that enables communication in both directions. The computing device 412 executes a program stored in the storage device 413 and performs reading and writing of various data. The computing device 412 may directly allocate a RAM, an HDD, an SSD, or the like to the CPU, the GPU, and the storage device 413 or may allocate a virtual environment such as a virtual machine. The server control unit 411 can perform transferring of information with the engine control unit 421 via the video controller 430.

Next, functions of the engine control unit 421 and the server control unit 411 according to the first embodiment will be described with reference to FIG. 5. Note that functions of the engine control unit 421 are realized by the CPU 422 executing a program deployed in the RAM 424. Also, functions of the server control unit 411 are realized by the computing device 412 of the server 410 executing a program stored in the storage device 413. The engine control unit 421 has a function related to feeding control and a function related to measuring of the feeding time, and the server control unit 411 has a function of determining whether the trailing edge regulating plate 26 is correctly set. Each will be described in order.

Figure 5:
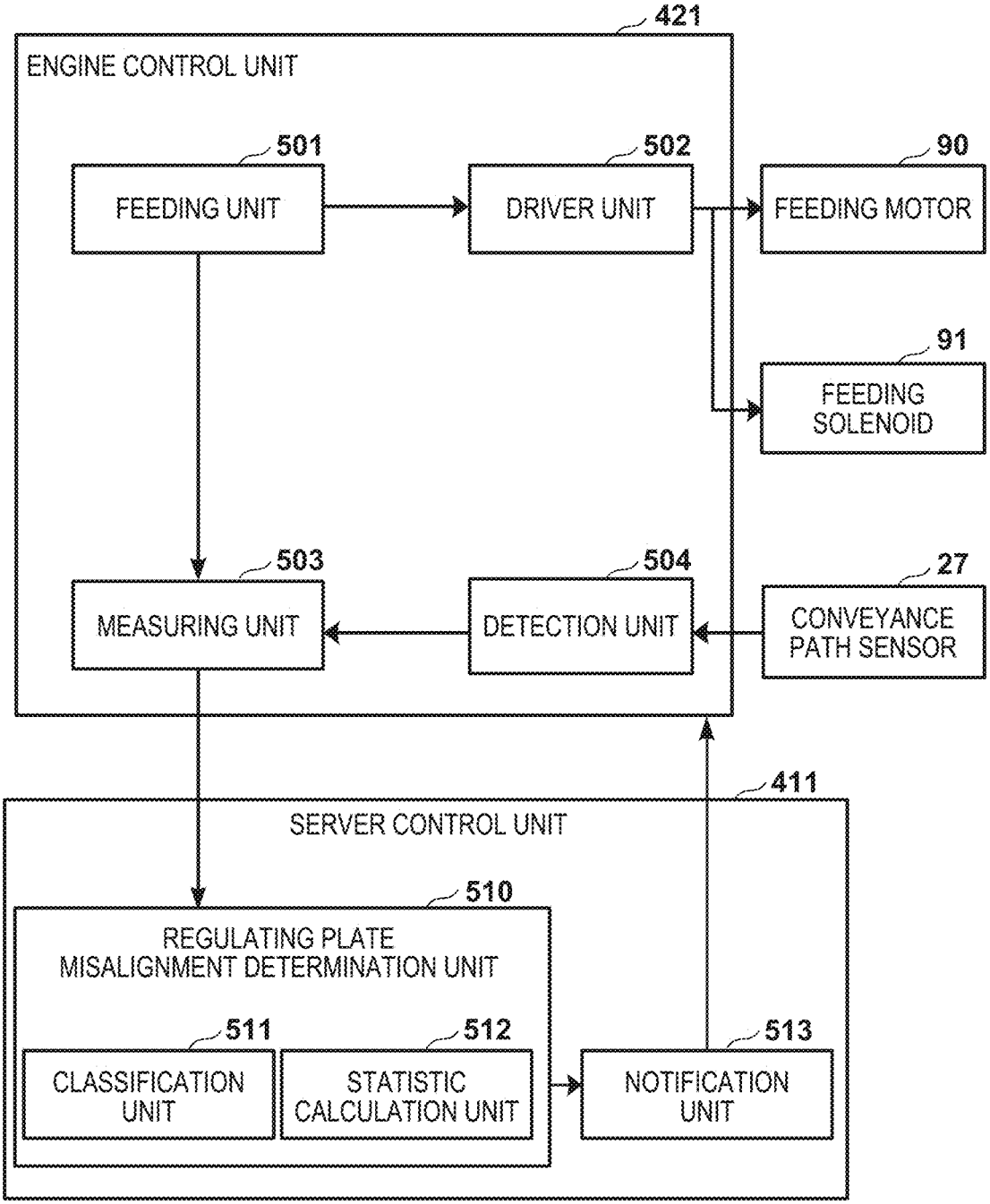
FIG. 5 is a functional block diagram describing the functions of an engine control unit and a server control unit according to the first embodiment.

FIG. 5 is a functional block diagram for describing functions of the engine control unit 421 and the server control unit 411 according to the first embodiment.

The engine control unit 421 has a feeding unit 501 and a driver unit 502 as functions related to the feeding control. When the printer engine 420 receives a print instruction, the feeding unit 501 instructs the driver unit 502 to perform a feeding operation. The driver unit 502, in accordance with the instruction of the feeding unit 501, rotates the conveyance roller 23 and the separation roller 24 by rotationally driving the feeding motor 90. Furthermore, at the timing of the start of feeding, by driving the feeding solenoid 91, the feeding roller 22 is made to perform one rotation. By this operation, the recording materials S that were pushed up in the feeding cassette 21 are separated, fed one by one, and then conveyed to the conveyance path sensor 27.

Next, the engine control unit 421 has a measuring unit 503 and a detection unit 504 as functions related to measuring of the feeding time. The measuring unit 503 measures the time from a timing when the feeding unit 501 instructs a feeding operation until the leading edge of the recording material S reaches the conveyance path sensor 27. This measuring is performed every time one sheet of the recording material S is fed, and the measured time is stored in the RAM 424 as feeding time data. The measuring unit 503 uses, for example, a timer incorporated in the CPU 422 as a measuring unit for measuring time. The feeding time data stored in the RAM 424 is also stored in the storage device 413 of the server control unit 411 via the video controller 430. The detection unit 504, based on an input signal from the conveyance path sensor 27, detects that the leading edge of the recording material S has reached the conveyance path sensor 27.

Figure 6:
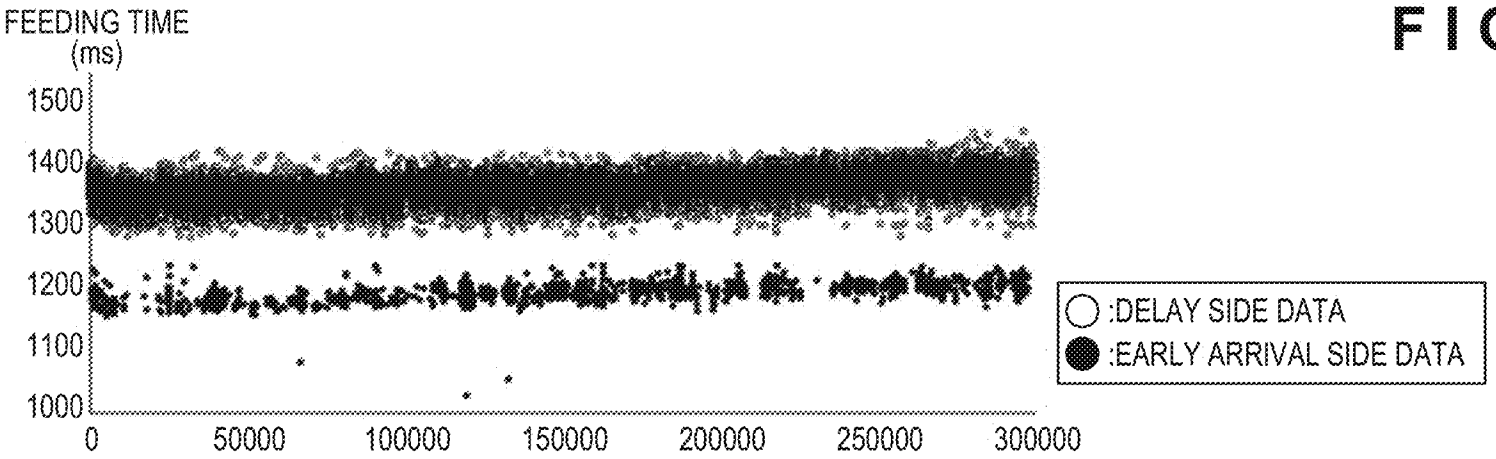
FIG. 6 is a graph view illustrating the relationship between the number of recording materials that are fed and the feeding times.

Next, the server control unit 411 has a regulating plate misalignment determination unit 510 as a function for determining whether or not the trailing edge regulating plate 26 is set correctly. The regulating plate misalignment determination unit 510 has a classification unit 511 and a statistic calculation unit 512. The classification unit 511 classifies a feeding time data set stored in the storage device 413 into a plurality of groups based on a predetermined criterion. In the first embodiment, the feeding time data set is classified into a delay side data set and an early arrival side data set as illustrated in FIG. 6. Here, the feeding time data that is 1250 ms or more (predetermined value or more) is made to be the delay side data, and the feeding time data that is less than 1250 ms (predetermined value) is made to be the early arrival side data. Also, the statistic calculation unit 512 calculates statistics from each of the classified groups. In the first embodiment, one statistic is calculated for each of the delay side data and the early arrival side data every 500 sheets. Also, in the first embodiment, one statistic is calculated when the number of delay side data N1 is 450 sheets and the number of early arrival side data N2 is 50 sheets.

A statistic DS of the delay side data is the data at the N1×5%=23rd position when the statistic is the top fifth percent (the n-th sheet, where n is a predetermined number) among the delay side data set.

FIG. 19A indicates the result of sorting the delay side data set in a descending order of values (from the most delayed), and the 23rd data is the statistic (1448 ms).

A statistic ES of the early arrival side data is N2×50%=25th data, when the statistic is the median value of the early arrival side data set. FIG. 19B is the result of sorting the early arrival side data set in ascending order of values (from the earliest), and the 25th data is the statistic (1170 ms).

Next, it is determined from the respective statistics whether or not the position of the trailing edge regulating plate 26 is misaligned from the set position in a direction opposite to the conveyance direction of the recording material. In this method, as described above, when both of the following two points are satisfied, it is determined that the position of the trailing edge regulating plate 26 is misaligned.

(1) The statistic DS on the delay side is more delayed than the data in a state in which the trailing edge regulating plate 26 is not misaligned.

(2) For the statistic ES on the early arrival side, there is no change from the data in a state in which the trailing edge regulating plate 26 is not misaligned.

A specific determination method will be described with reference to FIG. 7.

Figure 7:
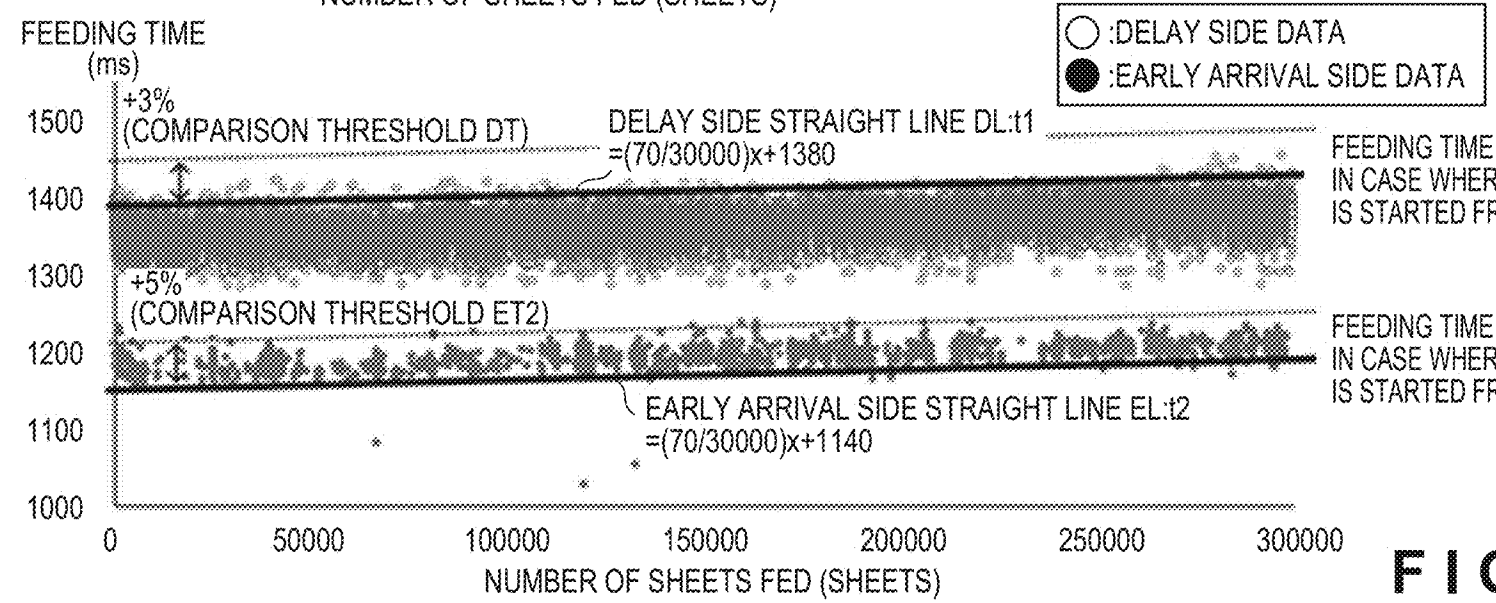
FIG. 7 is a graph view illustrating the relationship between the number of recording materials that are fed and the feeding times according to feeding start positions of the recording materials.

The feeding time in a case where feeding of the recording material is started from Ps can be approximated by the delay side straight line DL in FIG. 7. This data is a straight line decided in advance from experimental data, and when x is the number of sheets fed, t1 is the feeding time, α is the slope, and β is the intercept, the feeding time t1 is expressed by a linear function as in the following Expression (1).

$$t1=\alpha x+\beta \qquad \text{Expression (1)}$$

In the first embodiment, α=70/300000 and β=1380, and t1=1403, when the number of sheets fed x is 100000 sheets. In other words, in a case where the statistic of the delay side data described above is larger than the feeding time t1 when 100000 sheets of recording material are fed, it can be determined that the trailing edge regulating plate 26 is misaligned. In the first embodiment, in relation to this t1, a comparison threshold DT to the statistic DS of the delay side data is further obtained as follows by considering a margin m (%) set in advance.

$$DT = t1 \times \frac{100 + m}{100} \quad \text{Expression (2)}$$

In the first embodiment, when m=3, DT=1445.

Next, the feeding time in a case where feeding of the recording material is started from Pn can be approximated by the early arrival side straight line EL in FIG. 7. This data is a straight line decided in advance from experimental data, and when x is the number of sheets fed, t2 is the feeding time, α is the slope, and β is the intercept, the feeding time t2 is expressed by a linear function as in the following Expression (3).

$$t1 = \alpha x + \beta \quad \text{Expression (3)}$$

In the first embodiment, α=70/300000 and β=1140, and t2=1163, when x is 100000 sheets. In other words, the feeding time t2 when 100000 sheets of recording material are fed is set as a comparison threshold value ET1. Furthermore, a comparison threshold ET2 with respect to the statistic ES of the early arrival side data that considers a range r % preset from this ET1 is obtained by the following expression (4).

$$ET2 = ET1 \times \frac{100 + r}{100} \quad \text{Expression (4)}$$

In the first embodiment, when r=5, ET2=1221.

Here, two conditions described above for determining that the trailing edge regulating plate 26 is misaligned are expressed as follows by the following Expression (5).

(1) DS>DT (longer than estimated feeding time on the delay side when a predetermined number of sheets are fed)

(2) ET1<ES<ET2 (longer by a predetermined period of time than estimated feeding time on the early arrival side when a predetermined number of sheets are fed) . . . Expression (5)

In the first embodiment, when both of the above two conditions are satisfied, it is determined that the trailing edge regulating plate 26 is misaligned.

Finally, a notification unit 513 notifies the engine control unit 421 that the trailing edge regulating plate 26 is misaligned. Note that in the first embodiment, the units of the feeding times t1 and t2, the statistics DS and ES, and the comparison thresholds DT, ET1, and ET2 is milliseconds, and the units of the feeding number x is sheets.

Next, operation of the engine control unit 421 and the server control unit 411 according to the first embodiment will be described with reference to the flowchart of FIG. 8.

Figure 8:
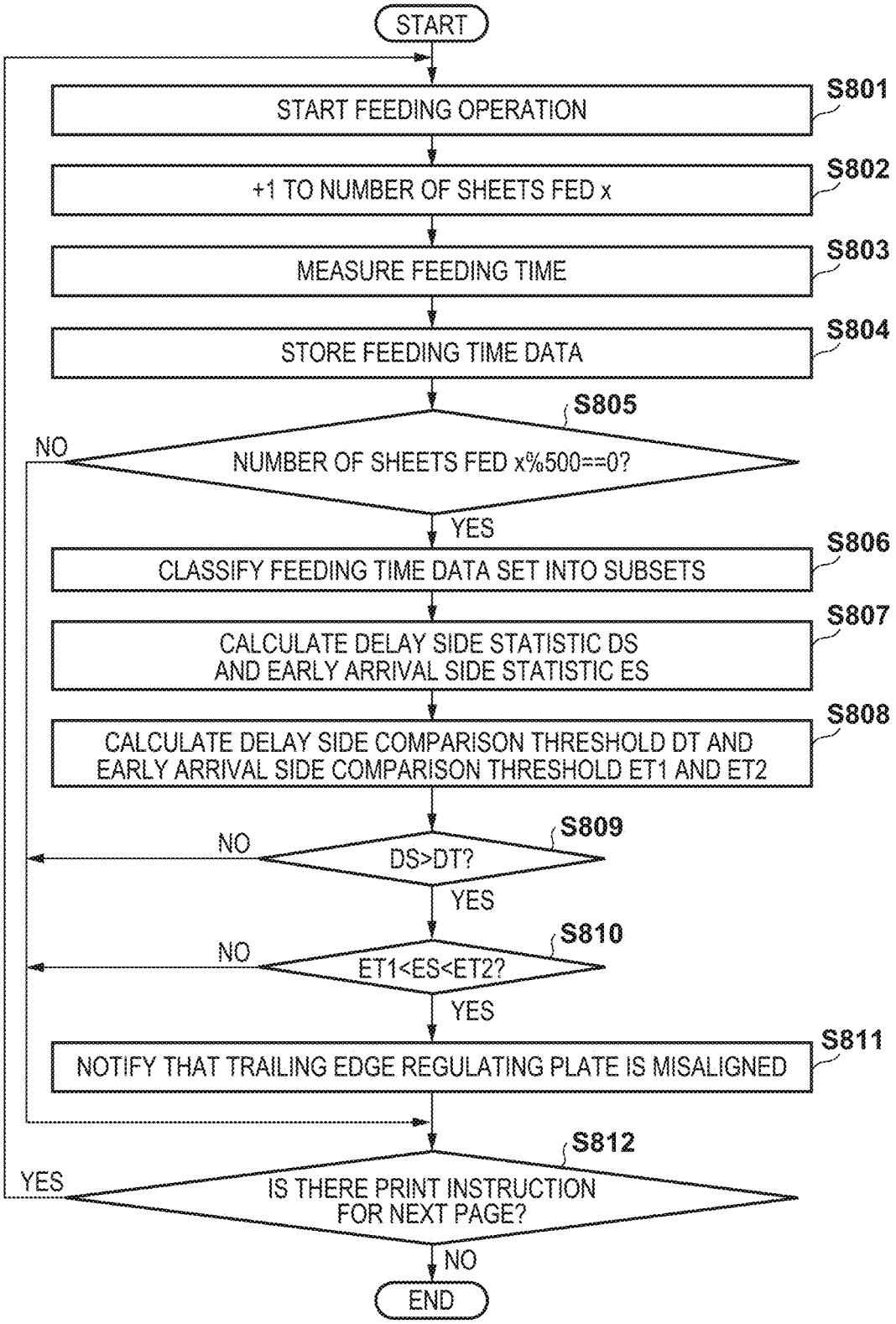
FIG. 8 is a flowchart describing processing for determining whether a trailing edge regulating plate is misaligned in the image forming apparatus according to the first embodiment.

FIG. 8 is a flowchart describing processing for determining whether the trailing edge regulating plate 26 is misaligned in the image forming apparatus 100 according to the first embodiment. Note that the processing indicated in this flowchart is realized by the CPU 422 executing a program deployed in the RAM 424 and working together with the server control unit 411.

This processing is started by the printer engine 420 receiving a print instruction, and first in step S801, the CPU 422 starts the feeding operation by the feeding unit 501 and the driver unit 502 and then starts the conveyance of the recording material S. Next, the processing proceeds to step S802 in which the CPU 422 increments the number of sheets fed x (variable provided in the RAM 424) by 1. Next, the processing proceeds to step S803 in which the CPU 422 performs measuring of the feeding time by the measuring unit 503 and the detection unit 504. In other words, based on the input signal from the conveyance path sensor 27, the CPU 422 obtains the time when the leading edge of the recording material S has reached the conveyance path sensor 27 and acquires the feeding time data by subtracting from that time the time when the feeding operation was started. The CPU 422 transmits the acquired feeding time data to the server control unit 411. Then the processing proceeds to step S804 in which the computing device 412 stores the received feeding time data in the storage device 413.

Next, the processing proceeds to step S805 in which the computing device 412 functions as the regulating plate misalignment determination unit 510 and determines whether or not the number of sheets fed x has reached 500 (predetermined number), and when data of 500 sheets of feeding time has accumulated, the processing proceeds to step S806 in which the computing device 412 functions as the classification unit 511 to classify the feeding time data set stored in the RAM 424 into a delay side data set and an early arrival side data set. Next, the processing proceeds to step S807 in which the computing device 412 functions as the statistic calculation unit 512 to calculate the delay side statistic DS and the early arrival side statistic ES. In the first embodiment, as described above, DS=1448 and ES=1170. Then, the processing proceeds to step S808 in which the computing device 412 functions as the regulating plate misalignment determination unit 510 to calculate the delay side comparison threshold DT and the early arrival side comparison thresholds ET1 and ET2. In the first embodiment, as described above, DT=1445, ET1=1163, and ET2=1221.

Next, the processing proceeds to step S809 in which the computing device 412 determines whether or not the trailing edge regulating plate misalignment determination condition of the delay side data, in other words, DS>DT, is satisfied. Here, if the delay side statistic DS>the delay side comparison threshold DT, the processing proceeds to step S810 in which the computing device 412 determines whether or not the trailing edge regulating plate misalignment determination condition of the early arrival side data, in other words, ET1<ES<ET2. Here, if the early arrival side comparison threshold value ET1<the early arrival side statistic ES<the early arrival side comparison threshold value ET2, it is determined that the trailing edge regulating plate 26 is misaligned, and the processing proceeds to step S811. In step S811, the computing device 412 functions as the notification unit 513 to notify the engine control unit 421 that the trailing edge regulating plate 26 is misaligned, and the processing proceeds to step S812. That the trailing edge regulating plate 26 is misaligned is displayed on the operation display unit 431 and notified to the host computer 400 of the user or dealer or a printer management tool (not shown). Then, in step S812, the CPU 422 functions as the engine control unit 421 to determine whether or not there is a print instruction for the next page, and if there is, to return to "start feeding operation" in step S801 again, and otherwise, the processing is ended.

Note that in the first embodiment, although a case where the configuration of a single feeding mechanism is exemplified, it is possible to apply to a configuration in which a plurality of feeding mechanisms are present. In a configuration in which a plurality of feeding mechanisms are present, the operations of the engine control unit 421 and the server control unit 411 are conducted independently for each feeding mechanism, and as a result, the determination of misalignment of the trailing edge regulating plate is conducted independently for each feeding mechanism.

According to the first embodiment as described above, by accurately detecting and notifying that the trailing edge regulating plate 26 is not correctly set, it is possible to prompt the user or dealer to reset the trailing edge regulating plate before conveyance failure of the recording material is detected. As a result, the user or dealer will no longer conduct unnecessary service calls, making it possible to reduce unnecessary cost.

Note that the present invention is not limited to the first embodiment, and for example, the printer engine 420 may be configured to have the regulating plate misalignment determination unit 510. Also, a clustering method such as a Gaussian mixture model or a K-means clustering may be used as a method for classifying the feeding time data set by the classification unit 511.

Also, although the notification unit 513 is made to return the determination result to the printer engine 420, a configuration may be taken so as to directly notify the result to the PC of the user or the PC or the server managed by the dealer. Furthermore, although the notification unit 513, in the first embodiment, notifies at every fixed number of sheets, a configuration may be taken so as to notify every time the user replenishes the recording material after the recording material in the feeding cassette 21 runs out, for example.

Also, although the regulating plate misalignment determination unit 510 determined, after one time, that the trailing edge regulating plate is misaligned, a configuration may be taken so as to perform the determination ten times, for example, and in a case where it is determined that the trailing edge regulating plate is misaligned by half or more or seven or eight times out of the ten times, for example, notify that the trailing edge regulating plate is misaligned.

Second Embodiment

In the first embodiment described above, a method was described in which, before conveyance failure of a recording material (sheet) occurs, it is determined that there is a positional misalignment of the trailing edge regulating plate and then the user or dealer is notified in advance. On the other hand, in the second embodiment, a method will be described in which, in a case where conveyance failure of the recording material is detected, it is determined whether or not the cause is that the trailing edge regulating plate is misaligned, and the result of the determination is notified. The description of the main parts is the same as that of the first embodiment, and only parts that are different from the first embodiment will be described here.

Figure 9:
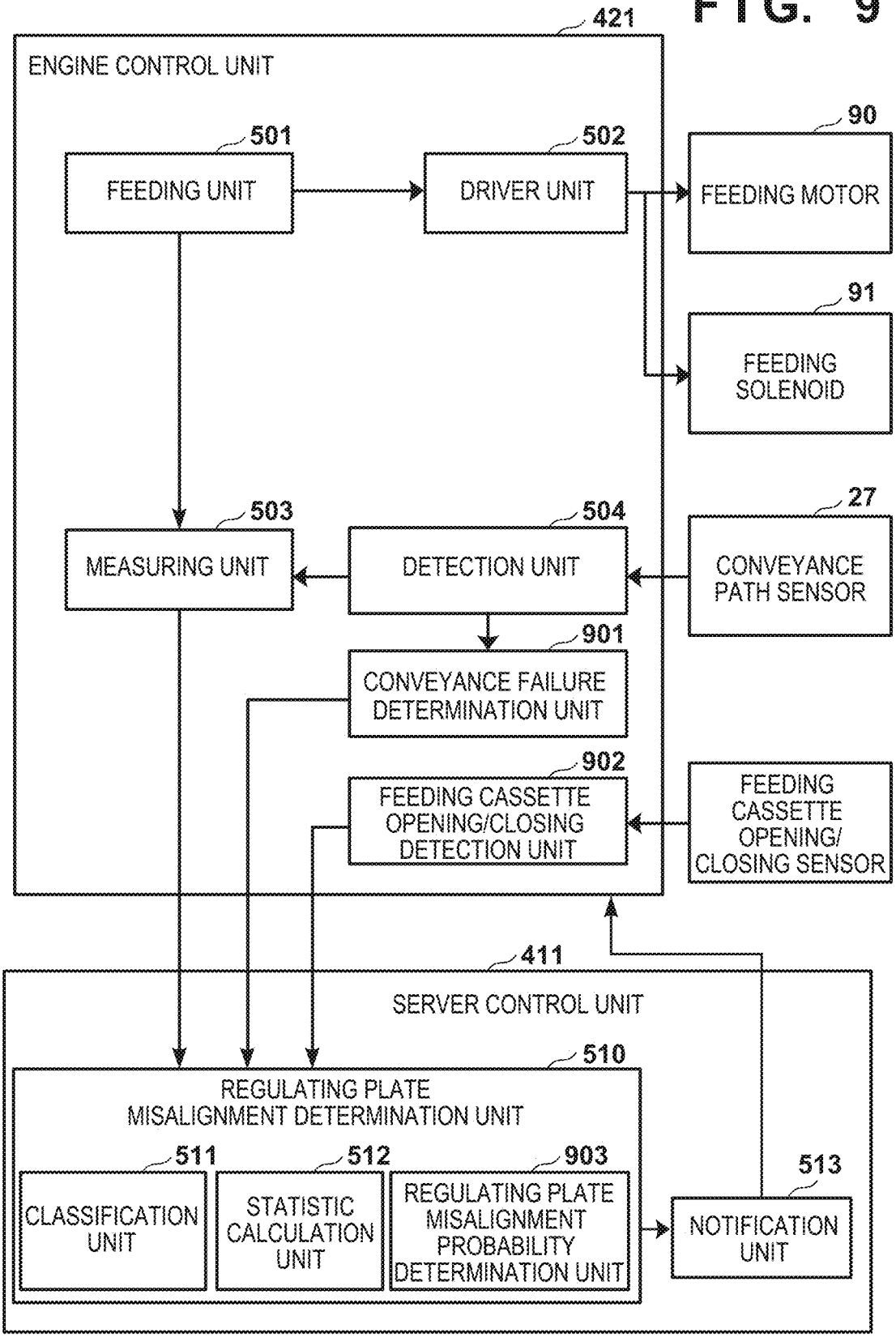
FIG. 9 is a functional block diagram describing the functions of an engine control unit and a server control unit according to a second embodiment.

FIG. 9 is a functional block diagram for describing functions of the engine control unit 421 and the server control unit 411 according to the second embodiment. Parts common to FIG. 5 of the first embodiment described above are indicated by the same reference numerals. The difference from FIG. 5 is that the engine control unit 421 has a conveyance failure determination unit 901 and a feeding cassette opening/closing detection unit 902, and the regulating plate misalignment determination unit 510 has a regulating plate misalignment probability determination unit 903.

The conveyance failure determination unit 901 detects conveyance failure of the recording material in a case where the detection unit 504 could not detect the leading edge of the recording material S for a predetermined time based on an input signal from the conveyance path sensor 27 and notifies the regulating plate misalignment determination unit 510. The regulating plate misalignment determination unit 510, upon receiving the notification from the conveyance failure determination unit 901, starts processing to determine whether or not the trailing edge regulating plate is misaligned.

The classification unit 511 classifies feeding time data set stored in the RAM 424 or the storage device 413 into groups as in the first embodiment. In the second embodiment, the feeding time data set uses the feeding time data from when the opening and closing of the feeding cassette is notified from the feeding cassette opening/closing detection unit 902 until conveyance failure of the recording material is detected. When opening and closing the feeding cassette 21, there is a high possibility that the user loads the recording material S into the feeding cassette 21 and operates the trailing edge regulating plate 26. Therefore, the accuracy may be improved more than when, for example, data set of every 500 sheets, which is arbitrary, is set.

Also, as in the First Embodiment, the statistic calculation unit 512 calculates statistics from each of the classified groups. In the second embodiment, the delay side data N1 from the opening and closing of the feeding cassette 21 until conveyance failure of the recording material is made to be 200 sheets, and the early arrival side data N2 is made to be 20 sheets. Then, the respective statistics are calculated as in the first embodiment. A statistic DS of the delay side data is the data at the N1×5%=10th position when the statistic is the top fifth percent among the delay side data set. FIG. 19C is the result of sorting the delay side data set in descending order of values (from the most delayed), and the 10th data is the statistic (1520 ms).

A statistic ES of the early arrival side data is N2×50%=10th data, when the statistic is the median value of the early arrival side data set. FIG. 19D is the result of sorting the early arrival side data set in ascending order of values (from the earliest), and the 10th data is the statistic (1167 ms).

Next, it is determined whether or not the trailing edge regulating plate 26 is misaligned from the respective statistics. This determination method, as in the first embodiment, first determines from two conditions.

The comparison threshold on the delay side in the second embodiment is DT=1445 from the Expressions (1) and (2) described above, when $\alpha$=70/300000, $\beta$=1380, x=100000, and m=3.

Also, the comparison threshold on the early arrival side is ET1=1163 and ET2=1221 from the Expressions (3) and (4) described above, when $\alpha$=70/300000. $\beta$=1140, x=100000, and r=5.

Here, in a case where the following two conditions shown in the above Expression (5) are satisfied, it is determined that there is a possibility that the trailing edge regulating plate 26 is misaligned.

(1) DS>DT (2) ET1<ES<ET2

Furthermore, in a case where the number of feeding time data from the opening and closing of the feeding cassette until conveyance failure of the recording material is detected is small, there is a risk that an incorrect determination will be made, and therefore, a determination is not conducted if the number of feeding time data is not more than 50. In the second embodiment, since the number of feeding time data is 220, the determination is conducted.

The regulating plate misalignment probability determination unit 903 determines the probability that the trailing edge regulating plate 26 is misaligned. As illustrated in FIG. 20A, first the reliability of the data increases as the number of feeding time data increases, so the probability is increased. Also, the larger the index i indicating the degree of misalignment in relation to t1 calculated from the delay side straight line DL, the higher the probability.

The index i is a misalignment rate (%) calculated by the following Expression (6).

$$i = \frac{DS}{t1} \times 100 - 100 \qquad \text{Expression (6)}$$

In the second embodiment, since DS=1520 and t1=1403, i=8.3. As illustrated in FIG. 20A, in a case where the number of data is 220 and i=8.3, it can be determined that the probability that the trailing edge regulating plate is misaligned is 90%.

Then, a notification unit 513 notifies the engine control unit 421 of the probability that the trailing edge regulating plate 26 is misaligned.

Figure 10:
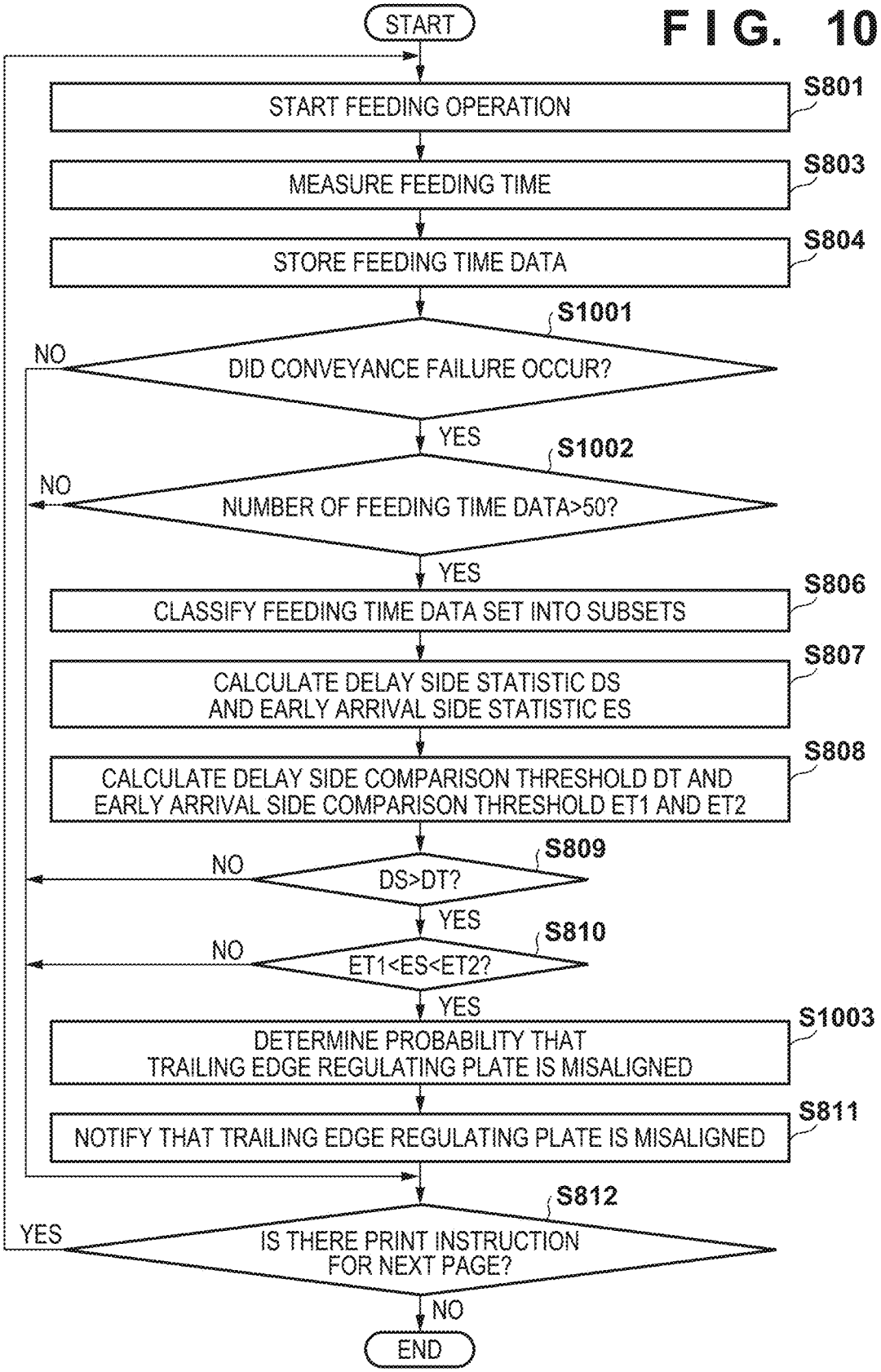
FIG. 10 is a flowchart describing processing for determining whether a trailing edge regulating plate is misaligned in the image forming apparatus according to the second embodiment.

FIG. 10 is a flowchart describing processing for determining whether the trailing edge regulating plate 26 is misaligned in the image forming apparatus 100 according to the second embodiment. Note that the processing indicated in this flowchart is realized by the CPU 422 executing a program deployed in the RAM 424 and working together with the server control unit 411. Note that in FIG. 10, processing that is the same as that of FIG. 8 of the first embodiment described above is denoted by the same reference numerals, and description thereof is omitted.

In step S1001, the CPU 422 determines whether or not conveyance failure of the recording material is detected. Here, when conveyance failure of the recording material is not detected, the processing proceeds to step S812; however, when conveyance failure of the recording material is detected, the processing proceeds to step S1002. In step S1002, the computing device 412 functions as the classification unit 511 to determine whether or not the number of data from the opening and closing of the feeding cassette 21 until conveyance failure of the recording material is notified is larger than 50. Here, when it is determined that the number is more than 50, steps S806 to S810 are executed to determine whether or not the trailing edge regulating plate 26 is misaligned. Then, in step S810, when it is determined that the trailing edge regulating plate 26 is misaligned, the processing proceeds to step S1003 in which the computing device 412 functions as the regulating plate misalignment probability determination unit 903 to acquire the probability that the trailing edge regulating plate is misaligned, with reference to FIG. 20A described above, from the number of the feeding time data and the index i indicating the misalignment rate.

In the second embodiment, since the number of feeding time data is 220 and i=8.3, it is determined that the probability that the trailing edge regulating plate is misaligned is 90%. Then, in step S811, the computing device 412 functions as the notification unit 513 to notify the engine control unit 421. The probability that the trailing edge regulating plate 26 is misaligned is displayed on the operation display unit 431 and notified to the host computer 400 of the user or dealer or a printer management tool (not shown).

As described above, according to the second embodiment, when conveyance failure of the recording material occurs, it is possible to notify in relation to the user or dealer that conveyance failure of the recording material has occurred due to the trailing edge regulating plate 26 not being set correctly and prompt the user to reset the trailing edge regulating plate. Also, it is possible to reduce an unnecessary service call being conducted by the user or dealer and an unnecessary replacement of consumables such as a feeding roller.

Third Embodiment

In the first and second embodiments described above, an example was described in which the misalignment of the regulating plate is detected and notified. On the other hand, in the third embodiment, a method for detecting a slip of a recording material and notifying the user or dealer of the occurrence of the slip of the recording material before conveyance failure of the recording material occurs will be described. The description of the main parts of the configuration according to a third embodiment is the same as that of the first and second embodiments, and only parts that are different from the first and second embodiments will be described here.

Figure 11A:
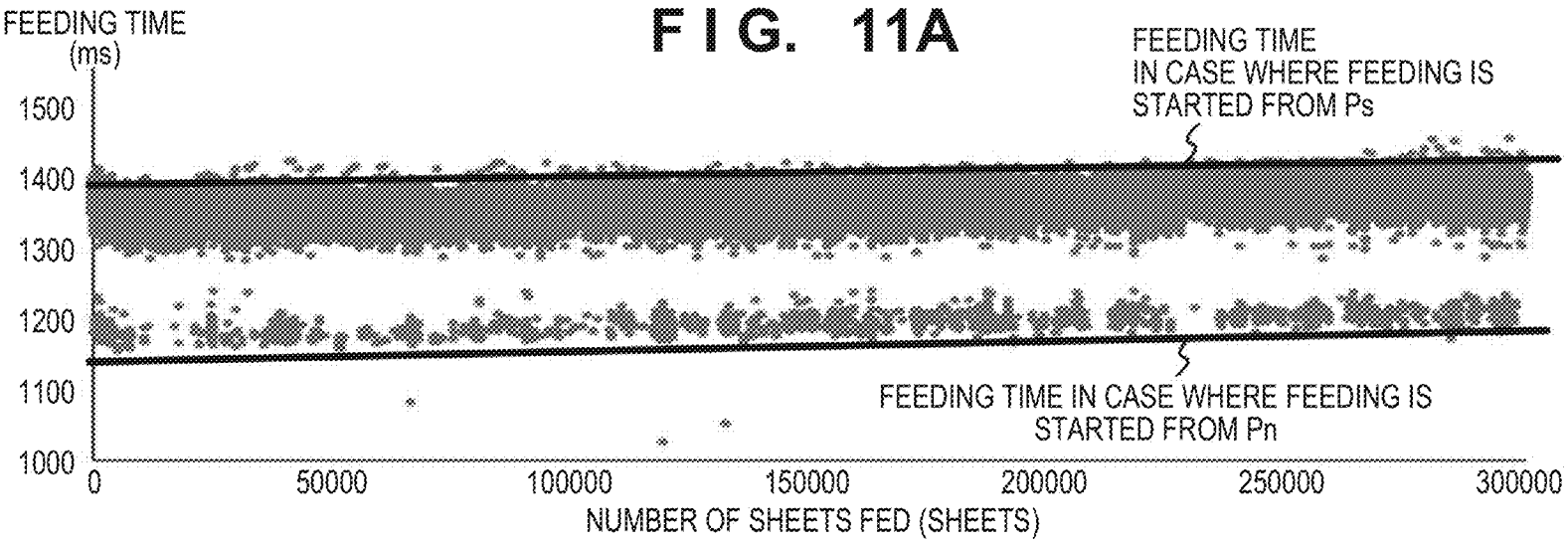
FIG. 11A and FIG. 11B are views illustrating examples of the transition of the feeding times when the feeding operation is repeated.

FIG. 11A is a view illustrating an example of the transition of the feeding times when the feeding operation is repeated. FIG. 11A, as in FIG. 3A, indicates an example in which, when the feeding operation of the recording material is repeated, the feeding time tends to be delayed in general. This is because, by repeating the feeding operation of the recording material, the feeding roller 22 is abraded and the frictional force between the feeding roller 22 and the recording material decreases. Also, as described above, in a case where the feeding is started from the separate nip Pn, the feeding time is faster, and in a case where the feeding is started from Ps, the feeding time is slower.

Figure 11B:
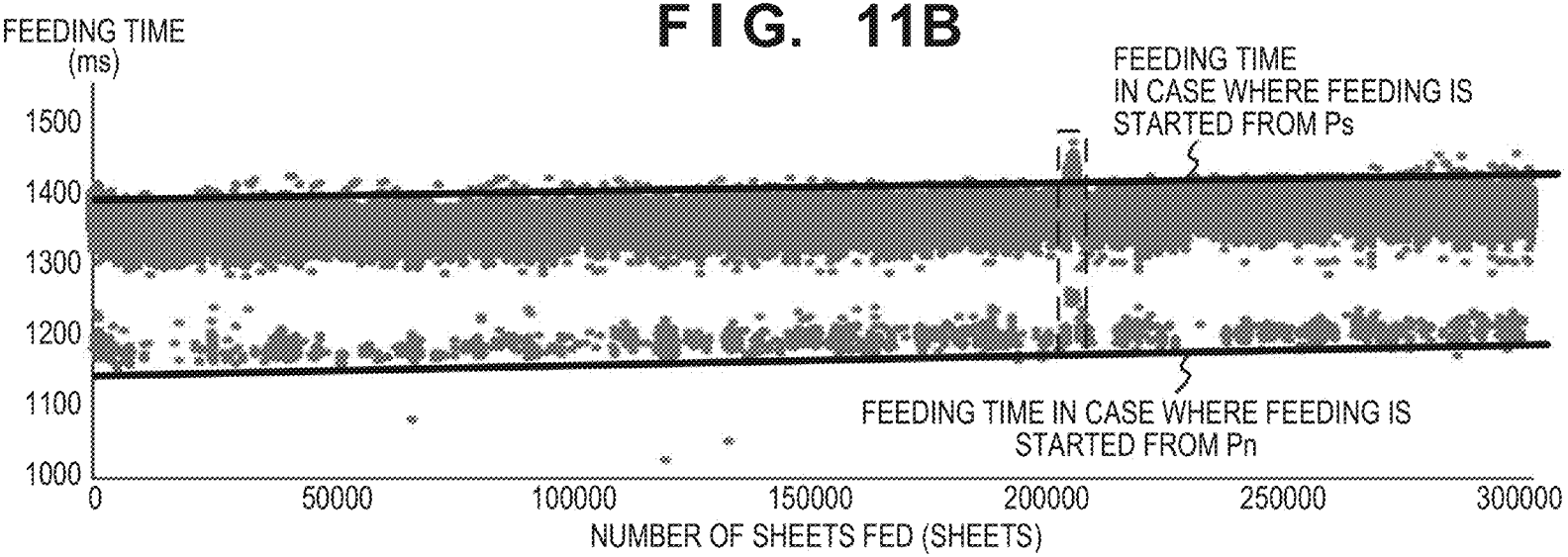

Meanwhile, the dotted line frame in FIG. 11B indicates data when a slip has occurred. In a case where a slip has occurred, both the delay side data and the early arrival side data tend to shift to a delay side. The reason why both the delay side data and the early arrival side data are delayed is that, regardless of the leading edge position of the recording material, frictional force is lowered between the recording material and the feeding roller 22/conveyance roller 23 due to a factor such as the surface property of the recording material and then the feeding roller slips.

Figure 12:
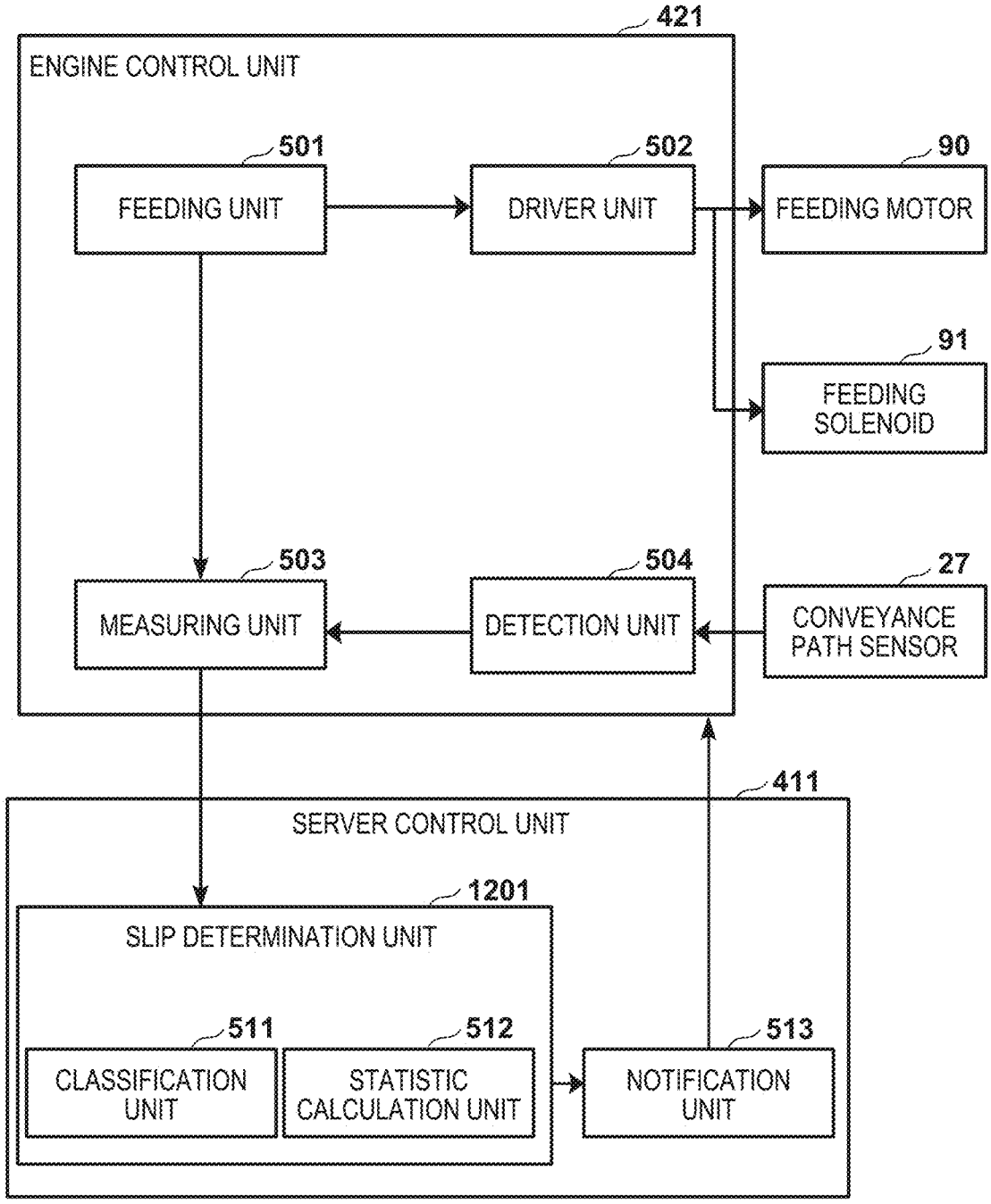
FIG. 12 is a functional block diagram describing the functions of an engine control unit and a server control unit according to a third embodiment.

FIG. 12 is a functional block diagram for describing functions of the engine control unit 421 and the server control unit 411 according to the third embodiment. Note that in FIG. 12, parts that are common to the previously-described embodiments are denoted by the same reference numerals, and description thereof is omitted.

The server control unit 411 has a slip determination unit 1201 as a function for determining whether or not slipping of the recording material is occurring. The slip determination unit 1201 has the classification unit 511 and the statistic calculation unit 512. The classification unit 511 has the same function as that of the classification unit 511 in the first and second embodiments described above. In the third embodiment, the feeding time of 1300 ms or more is the delay side data, and other data is the early arrival side data. Also, the statistic calculation unit 512 calculates statistics from each of the classified groups. In the third embodiment, one statistic is calculated for each of the delay side data and the early arrival side data every 500 sheets. In the third embodiment, the delay side data N1 is 450 sheets and the early arrival side data N2 is 50 sheets.

A statistic DS of the delay side data is the data at the N1×5%=23rd position when the statistic is the top fifth percent among the delay side data set. FIG. 20B indicates the result of sorting the delay side data set in a descending order of values (from the most delayed), and the 23rd data is the statistic (1478 ms).

A statistic ES of the early arrival side data is N2×50%=25th data, when the statistic is the median value of the early arrival side data set. FIG. 20C indicates an example of the result of sorting the early arrival side data set in ascending order of values (from the earliest), and the 25th data is the statistic (1260 ms).

Next, it is determined whether or not slipping occurred from the respective statistics. In this determination method, as described above, in a case where both of the following two points are satisfied, it is determined that a slip has occurred.

(1) The statistic DS on the delay side is more delayed than data in a state in which slipping has not occurred.

(2) The statistic ES on the early arrival side is more delayed than data in a state in which slipping has not occurred.

The comparison threshold on the delay side of the third embodiment is calculated as in the first embodiment. In the third embodiment is DT=1469 from the Expressions (1) and (2) described above, when $\alpha$=70/300000, $\beta$=1380, x=200000, and m=3.

The comparison threshold on the early arrival side of the third embodiment is calculated as in the first embodiment. In the third embodiment is ET2=1246 from the Expression (4) described above, when $\alpha$=70/300000, $\beta$=1140, x=200000, and r=5.

Here, two conditions for determining that the slip described above has occurred are expressed by the following expression.

(1) DS>DT (longer than estimated feeding time on the delay side when a predetermined number of sheets are fed)

(2) ES>ET2 (longer than estimated feeding time on the early arrival side when a predetermined number of sheets are fed)

In the third embodiment, in a case where both of the above two conditions are satisfied, it is determined that slipping of the recording material is occurring. The notification unit 513 notifies the engine control unit 421 that slipping of the recording material is occurring.

Figure 13:
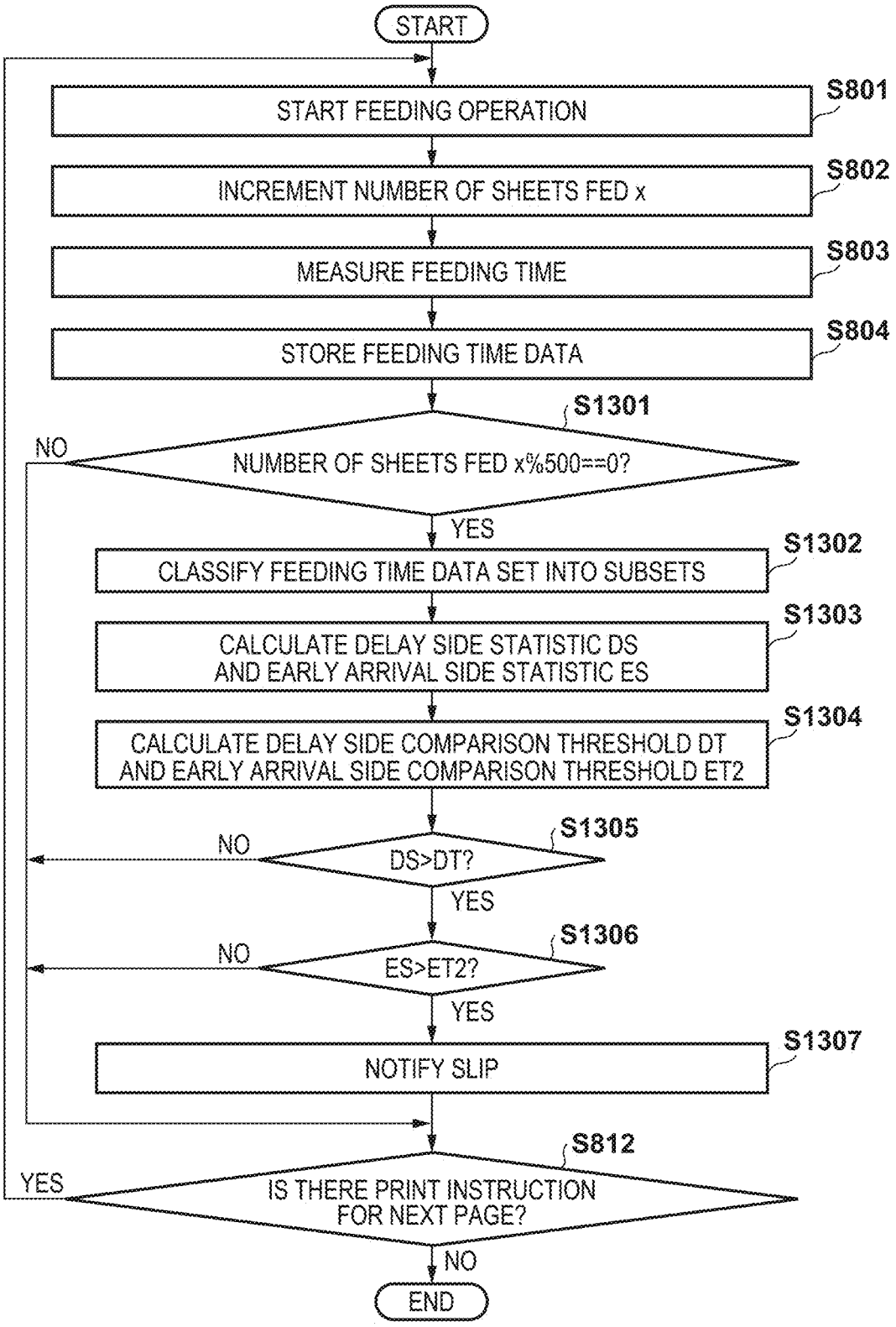
FIG. 13 is a flowchart describing processing for determining whether slipping of a recording material is occurring in the image forming apparatus according to the third embodiment.

FIG. 13 is a flowchart describing processing for determining whether slipping of the recording material is occurring in the image forming apparatus 100 according to the third embodiment. Note that the processing indicated in this flowchart is realized by the CPU 422 executing a program deployed in the RAM 424 and working together with the server control unit 411. Note that in FIG. 13, processing that is the same as that of FIG. 8 of the first embodiment described above is denoted by the same reference numerals, and description thereof is omitted.

In step S1301, the computing device 412 functions as the slip determination unit 1201 and determines whether or not the number of sheets fed x is 500, and whenever 500 sheets worth of feeding time data accumulates, the processing advances to step S1302. In step S1302, the computing device 412 functions as the classification unit 511 to classify the feeding time data set stored in the RAM 424 into a delay side data set and an early arrival side data set. Next, the processing proceeds to step S1303 in which the computing device 412 functions as the statistic calculation unit 512 to calculate the delay side statistic DS and the early arrival side statistic ES. In the third embodiment, as described above, DS=1478 and ES=1260. Then, the processing proceeds to step S1304 in which the computing device 412 functions as the slip determination unit 1201 to calculate the delay side comparison threshold DT and the early arrival side comparison threshold ET2. In the third embodiment, as described above, DS=1469 and ET2=1246.

Then, the processing proceeds to step S1305 in which the computing device 412 determines whether or not the slip determination condition of the delay side data is satisfied. Here, if the delay side statistic DS>the delay side comparison threshold DT, the processing proceeds to step S1306 in which the computing device 412 determines whether or not the determination condition for slipping of the early arrival side data is satisfied. If the early arrival side statistic ES>the early arrival side comparison threshold ET2, the processing proceeds to step S1307 in which the computing device 412 functions as the notification unit 513 to notify the engine control unit 421 that slipping of the recording material is occurring. That slipping of the recording material is occurring is displayed on the operation display unit 431 and notified to the host computer 400 of the user or dealer or a printer management tool (not shown). Then, finally, in step S812, the CPU 422 functions as the engine control unit 421 to determine whether or not there is a print instruction for the next page, and if there is, to return to "start feeding operation" in step S801 again, and otherwise, ends the control.

Note that in the third embodiment, although a case where the configuration of a single feeding mechanism is exemplified, it is possible to apply to a configuration in which a plurality of feeding mechanisms are present. In a configuration in which a plurality of feeding mechanisms are present, the operations of the engine control unit 421 and the server control unit 411 are conducted independently for each feeding mechanism, and as a result, the determination slipping is conducted independently for each feeding mechanism.

As described above, according to the third embodiment, it is possible to accurately detect and notify that slipping of the recording material is occurring. Also, it is possible to prompt the user or dealer to replace the recording material or the feeding roller before conveyance failure of the recording material occurs.

Note that the present invention is not limited to the third embodiment. For example, the printer engine 420 may be configured to have the slip determination unit 1201. Also, a clustering method such as a Gaussian mixture model or a K-means clustering may be used as a method for classifying the feeding time data set by the classification unit 511.

Also, although the notification unit 513 is made to return the determination result to the printer engine 420, a configuration may be taken so as to directly notify the result to the PC of the user or the PC or the server managed by the dealer. Furthermore, although the notification unit 513, in the third embodiment, notifies at every predetermined number of sheets, a configuration may be taken so as to notify every time the user replenishes the recording material after the recording material in the feeding cassette 21 runs out, for example.

Also, although the slip determination unit 1201 determined, after one time, that slipping is occurring, a configuration may be taken so as to perform the determination ten times, for example, and in a case where it is determined that slipping is occurring half or more times, for example, notify that slipping of the recording material is occurring. Also, the notification of the slipping of the recording material of the third embodiment may be performed in combination with the notification of the misalignment of the regulating plate of the first and second embodiments.

Fourth Embodiment

In the third embodiment, a method for notifying the user or dealer of the occurrence of slipping before the occurrence of conveyance failure of a recording material has been described. On the other hand, in the fourth embodiment, an example will be described in which, in a case where conveyance failure of the recording material occurred, it is notified that the cause thereof is slipping of the recording material. The description of the main parts is the same as that of the second and third embodiments, and only parts that are different from the second and third embodiments will be described here.

Figure 14:
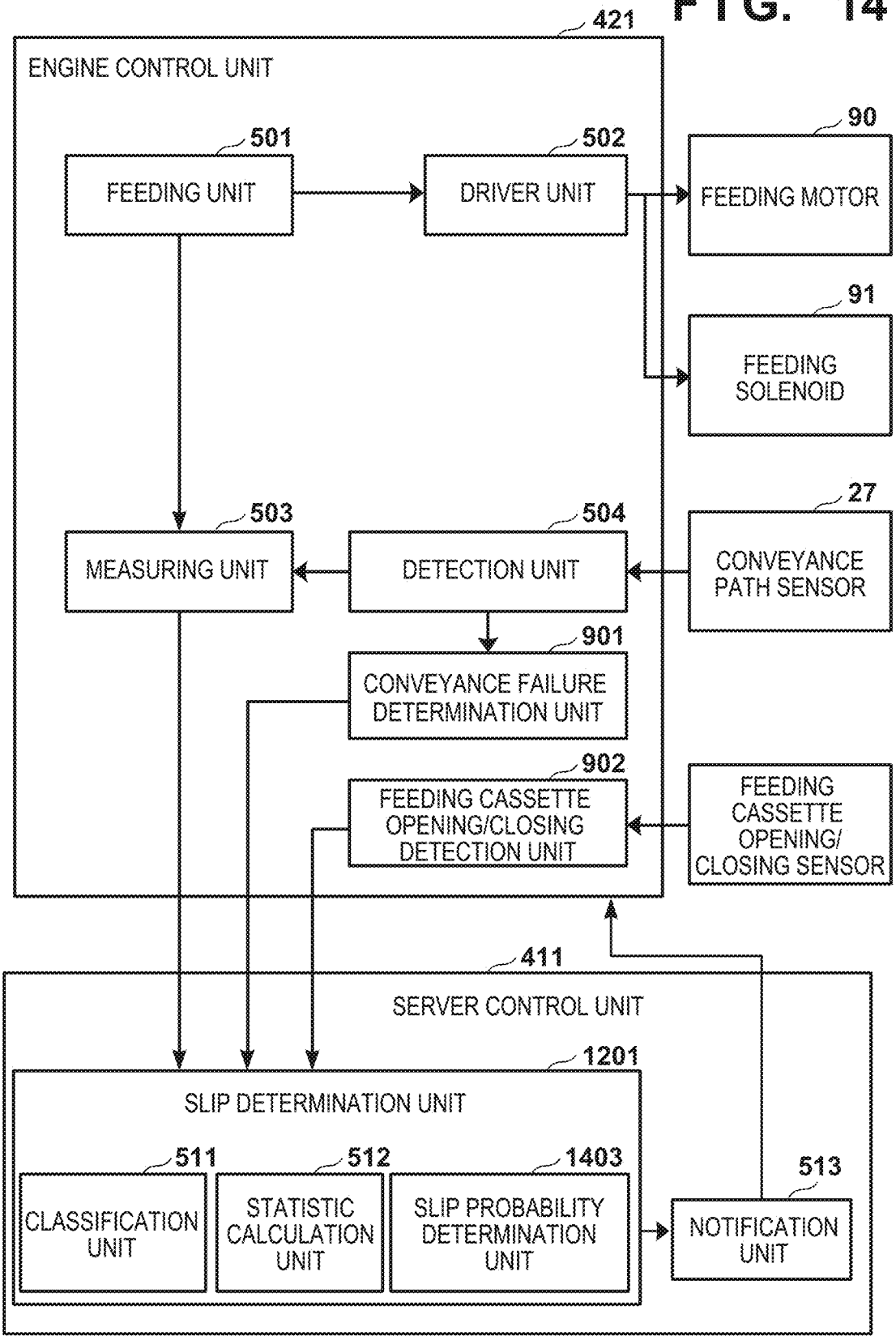
FIG. 14 is a functional block diagram describing the functions of an engine control unit and a server control unit according to a fourth embodiment.

FIG. 14 is a functional block diagram for describing functions of the engine control unit 421 and the server control unit 411 according to the fourth embodiment. Parts common to FIG. 9 and FIG. 12 of the second and third embodiments described above are indicated by the same reference numerals. The difference from FIG. 12 is that the engine control unit 421 has the conveyance failure determination unit 901 and the feeding cassette opening/closing detection unit 902, and the slip determination unit 1201 has a slip probability determination unit 1403.

The slip determination unit 1201 starts processing to determine the presence or absence of a slip of the recording material upon receiving a notification of conveyance failure of the recording material from the conveyance failure determination unit 901. The classification unit 511 classifies a feeding time data set stored in the RAM 424 into groups similarly to the third embodiment. In the fourth embodiment, the feeding time data set uses the feeding time data from when the opening and closing of the feeding cassette 21 is detected by the feeding cassette opening/closing detection unit 902 until conveyance failure of the recording material is detected. Also, as in the third embodiment, the statistic calculation unit 512 calculates statistics from each of the classified groups. In the third embodiment, the delay side data N1 from the opening and closing of the feeding cassette 21 until conveyance failure is made to be 200 sheets, and the early arrival side data N2 is made to be 20 sheets. Then, the respective statistics are calculated as in the third embodiment. A statistic DS of the delay side data is the data at the N1×5%=10th position when the statistic is the top fifth percent (the n-th largest data, where n is a predetermined number) among the delay side data set. FIG. 21A indicates an example of a result of sorting the delay side data set in a descending order of values (from the most delayed), and the 10th data is the statistic (1550 ms).

A statistic ES of the early arrival side data is N2×50%=10th data, when the statistic is the median value of the early arrival side data set. FIG. 21B indicates an example of the result of sorting the early arrival side data set in ascending order of values (from the earliest), and the 10th data is the statistic (1290 ms).

Next, it is determined whether or not slipping occurred from the respective statistics. This determination method, as in the third embodiment, first determines from two conditions.

The comparison threshold on the delay side in the fourth embodiment is DT=1469 from the Expressions (1) and (2) described above, when $\alpha$=70/300000, $\beta$=1380, x=200000, and m=3.

The comparison threshold ET on the early arrival side is ET2=1246 from Expression (4) described above, when $\alpha$=70/300000, $\beta$=1140, x=200000, and r=5.

Here, in a case where the following two conditions described above are satisfied, it is determined that there is a possibility that slipping of the recording material is occurring.

(1)DS>DT (2) ES>ET2

Furthermore, in a case where the number of feeding time data from the opening and closing of the feeding cassette until conveyance failure of the recording material is detected and notified is small, there is a risk that an incorrect determination will be made, and therefore, a determination is not conducted if the number of feeding time data is not more than 50. In the fourth embodiment, since the number of feeding time data is 220, the determination processing is conducted.

The slip determination unit 1201 further determines the probability of slipping occurring. As illustrated in FIG. 21C, first the reliability of the data increases as the number of feeding time data increases, so the probability is increased. Also, the larger the index i indicating the rate of misalignment in relation to t1 calculated from the delay side straight line DL and t2 calculated from the early arrival side straight line EL, the higher the probability.

The index i is a misalignment rate (%) calculated by the following Expression (7).

$$i = \frac{\left(\frac{DS}{t1} \times 100 - 100\right) + \left(\frac{ES}{t2} \times 100 - 100\right)}{2} \qquad \text{Expression (7)}$$

This Expression (7) represents the average of a misalignment rate between t1 calculated from the delay side straight line DL and the statistic DS on the delay side and the misalignment rate between t2 calculated from the early arrival side straight line EL and the statistic ES on the early arrival side.

In the fourth embodiment, since DS=1550, t1=1426, ES=1290, and t2=1186, i=8.6. From FIG. 21C, it can be predicted from the number of data 220 and i=8.6, that the probability of slipping occurring is 90%. The notification unit 513 notifies to the engine control unit 421 the probability that slipping is occurring.

Figure 15:
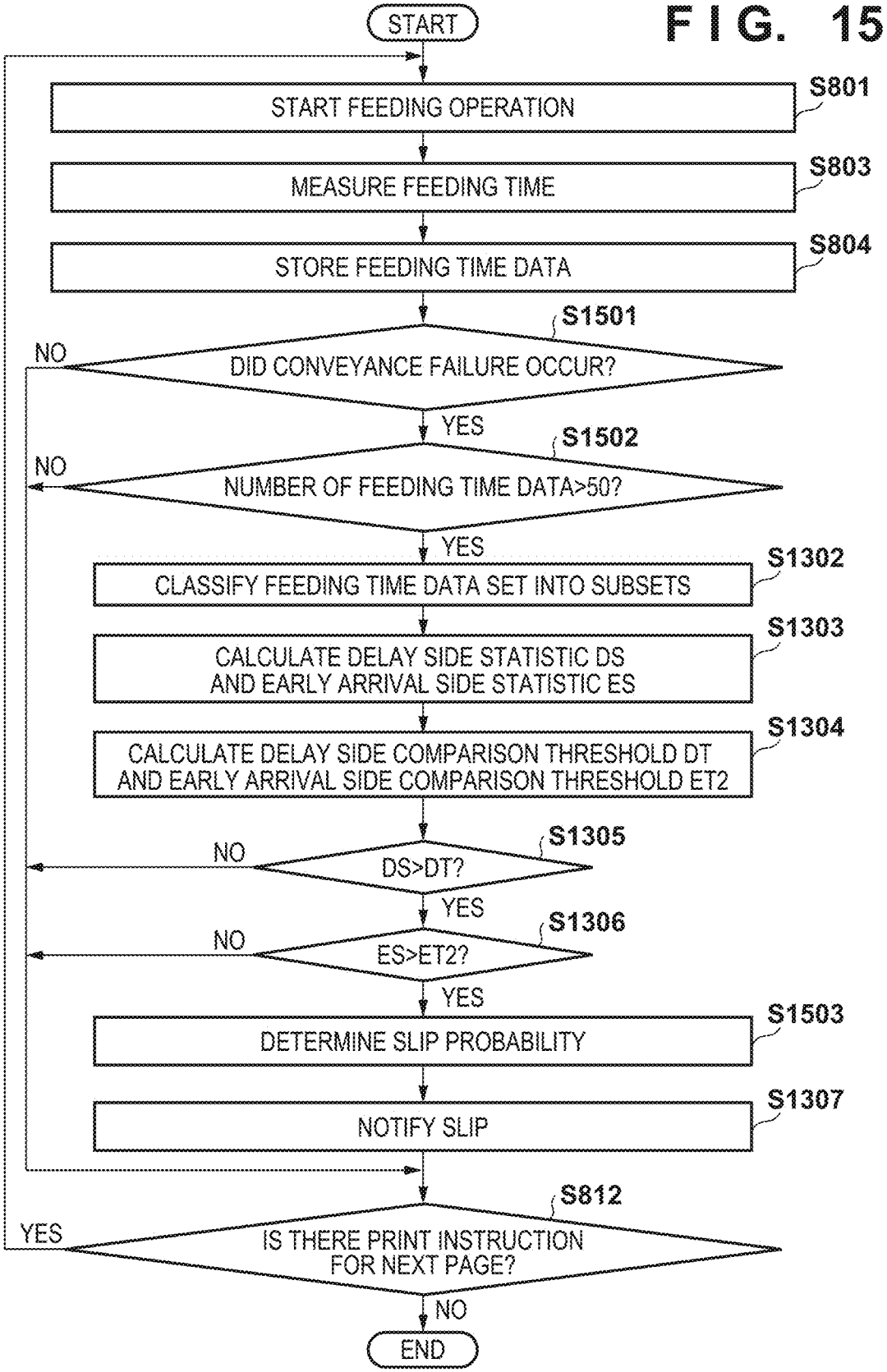
FIG. 15 is a flowchart describing processing for determining whether slipping of a recording material is occurring in the image forming apparatus according to the fourth embodiment.

FIG. 15 is a flowchart describing processing for determining whether slipping of the recording material is occurring in the image forming apparatus 100 according to according to the fourth embodiment. Note that the processing indicated in this flowchart is realized by the CPU 422 executing a program deployed in the RAM 424 and working together with the server control unit 411. Note that in FIG. 15, processing that is the same as that of FIG. 13 of the third embodiment described above is denoted by the same reference numerals, and description thereof is omitted.

In step S1501, the CPU 422 determines whether or not conveyance failure of the recording material is notified. When it is determined that there is conveyance failure, the processing proceeds to step S1502 in which the computing device 412 functions as the classification unit 511 to determine whether or not the number of feeding time data from the opening and closing of the feeding cassette 21 until conveyance failure is 50 or more. If it is 50 or more, the processing proceeds to step S1302 in which the computing device 412 executes the same processing as the processing from steps S1302 to S1306 in FIG. 13 described above. Since DS=1550, DT=1469, ES=1290, and ET2=1246. DS>DT and ES>ET2 are satisfied, and the computing device 412 determines that a slip has occurred and proceeds to step S1503. In step S1503, the computing device 412 functions as the slip probability determination unit 1403 to calculate an index i indicating the number of feeding time data and the slip ratio from Expression (7) and to decide from the index i, with reference to the table in FIG. 21C, the probability of slipping occurring.

In the fourth embodiment, since the number of feeding time data is 220 and i=8.6, the probability of slipping occurring is decided to be 90%, and the notification unit 513 notifies the engine control unit 421 in step S1307. The probability of slipping occurring is displayed on the operation display unit 431 and notified to the host computer 400 of the user or dealer or a printer management tool (not shown).

As described above, according to the fourth embodiment, when conveyance failure of the recording material has occurred, it is possible to notify in relation to the user or dealer that conveyance failure has occurred due to slipping of the recording material occurring. As a result, it becomes possible to prompt the user and dealer to replace the recording material and/or the feeding roller.

Fifth Embodiment

In the third and fourth embodiments described above, the method for detecting and notifying the occurrence of slipping of the recording material was described. In the fifth embodiment, an example will be described in which, in a case where slipping of the recording material is detected, the operation is switched to an operation that makes it easier to avoid conveyance failure of the recording material. The description of the main parts is the same as that of the third and fourth embodiments, and only parts that are different from the third and fourth embodiments will be described here.

Figure 16:
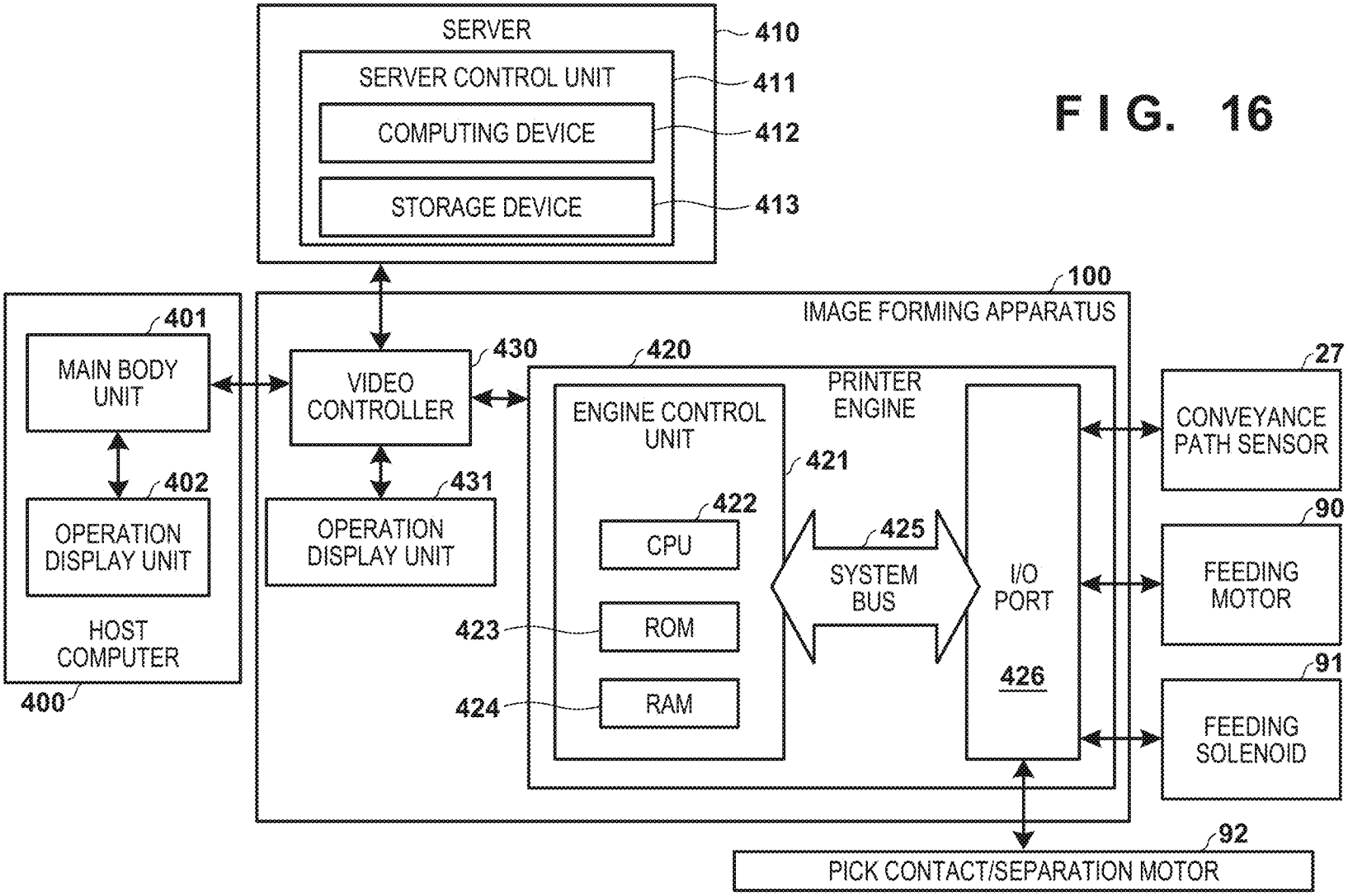
FIG. 16 is a block diagram describing a hardware configuration of the image forming apparatus and a configuration of an image forming system that includes the image forming apparatus according to a fifth embodiment.

FIG. 16 is a block diagram describing a hardware configuration of the image forming apparatus 100 and a configuration of an image forming system that includes the image forming apparatus 100 according to the fifth embodiment.

The image forming apparatus 100 according to the fifth embodiment differs from the embodiment described above in that it has a pick contact/separation motor 92. The conveyance path sensor 27, the feeding motor 90, the feeding solenoid 91, the feeding roller 22, and the pick contact/separation motor 92 are connected to each IO port 426.

The feeding mechanism 20 of the fifth embodiment has the pick contact/separation motor 92 (not shown) in relation to the feeding mechanism in FIG. 2. The feeding roller 22 is made so that it can be driven in a direction perpendicular in relation to the recording material S by the pick contact/separation motor 92. When the pick contact/separation motor 92 is rotated forward, the feeding roller 22 is driven in the direction in which it contacts the recording material S, and when the pick contact/separation motor 92 is rotated backward, the feeding roller 22 is driven in the direction in which it separates from the recording material S. Also, by changing the time to rotate the pick contact/separation motor 92 forward, it is possible to adjust the contact pressure between the feeding roller 22 and the recording material S. The stronger the contact pressure between the feeding roller 22 and the recording material S, the larger the frictional force between the feeding roller 22 and the recording material S, so slipping of the recording material is less likely to occur.

Figure 17:
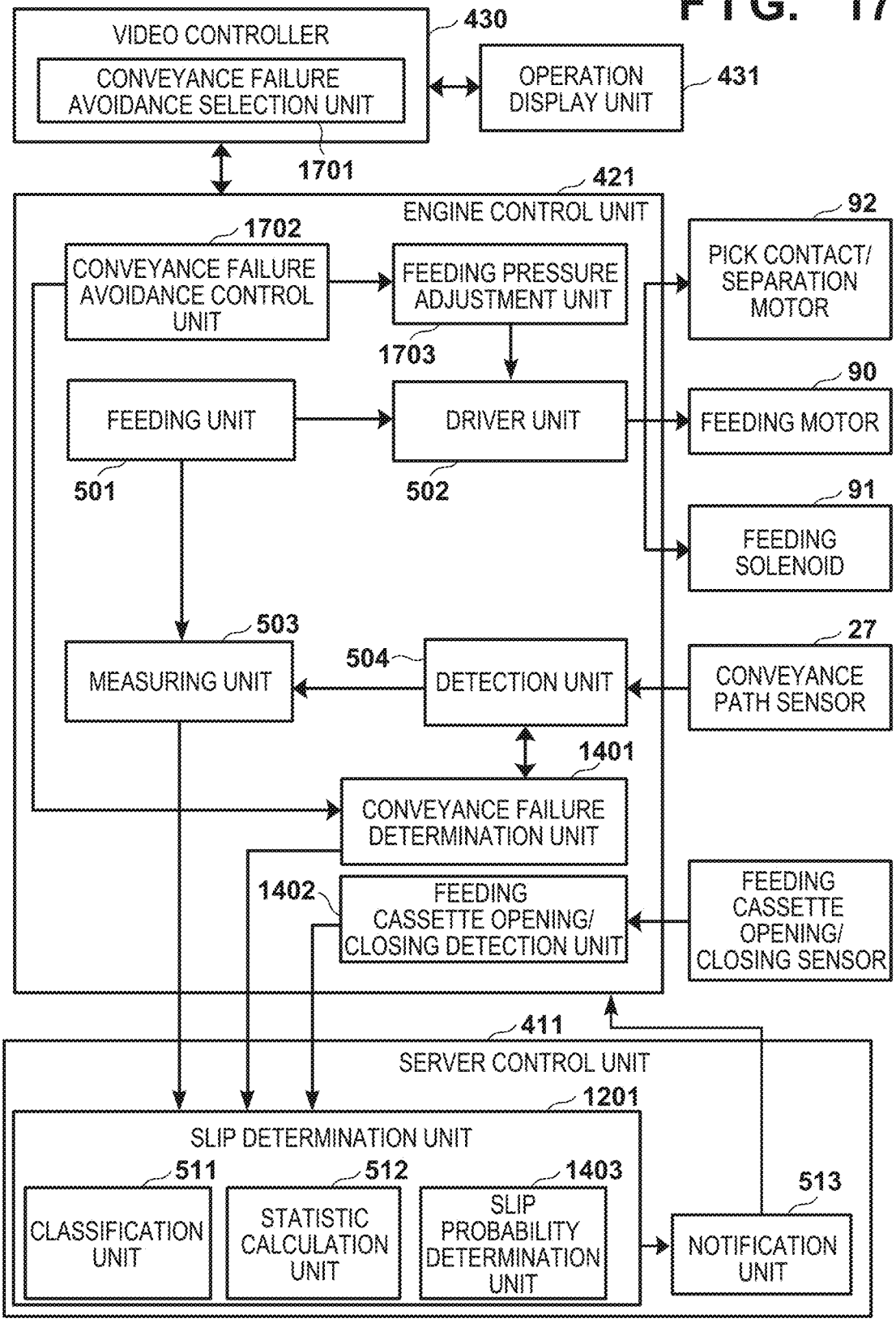
FIG. 17 is a functional block diagram describing the functions of an engine control unit and a server control unit according to the fifth embodiment.

FIG. 17 is a functional block diagram for describing functions of the engine control unit 421 and the server control unit 411 according to the fifth embodiment. Parts common to FIG. 14 of the fourth embodiment described above are indicated by the same reference numerals. The difference from FIG. 14 is that the video controller 430 has a conveyance failure avoidance selection unit 1701 and that the engine control unit 421 has a conveyance failure avoidance control unit 1702 and a feeding pressure adjustment unit 1703 to control the pick contact/separation motor 92.

The conveyance failure avoidance selection unit 1701 causes the operation display unit 431 to display a selection screen on whether or not to avoid conveyance failure when slipping of the recording material occurs. In a case where the user selects to avoid conveyance failure, the video controller 430 performs an instruction to the engine control unit 421 to avoid conveyance failure.

The conveyance failure avoidance control unit 1702, in a case where the probability of slipping of the recording material occurring received from the notification unit 513 exceeds a predetermined threshold value (50% in the present fifth embodiment) and an instruction to avoid conveyance failure is received from the video controller 430, an operation to avoid conveyance failure such as those indicated in the following (A) and (B) is performed. (A) Strengthening of the contact pressure between the feeding roller 22 and the recording material S by the feeding pressure adjustment unit 1703. (B) Change in the time for detecting conveyance failure of the recording material by the conveyance failure determination unit 901.

In the case of (A), when the conveyance failure avoidance control unit 1702 instructs the feeding pressure adjustment unit 1703 to increase the feeding pressure by the feeding roller, the time for the feeding pressure adjustment unit 1703 to rotate the pick contact/separation motor 92 forward is made longer than normal by 10 ms. As a result, the contact pressure between the feeding roller 22 and the recording material is increased, so that slipping of the recording material is less likely to occur.

In the case of (B), the time until the determination of conveyance failure, in a case where the leading edge of the recording material S cannot be detected by the conveyance failure determination unit 901, is made longer than normal by 500 ms by the conveyance failure avoidance control unit 1702. As described above, by lengthening the time until the determination of conveyance failure, conveyance failure due to slipping of the recording material is less likely to occur.

Figure 18A:
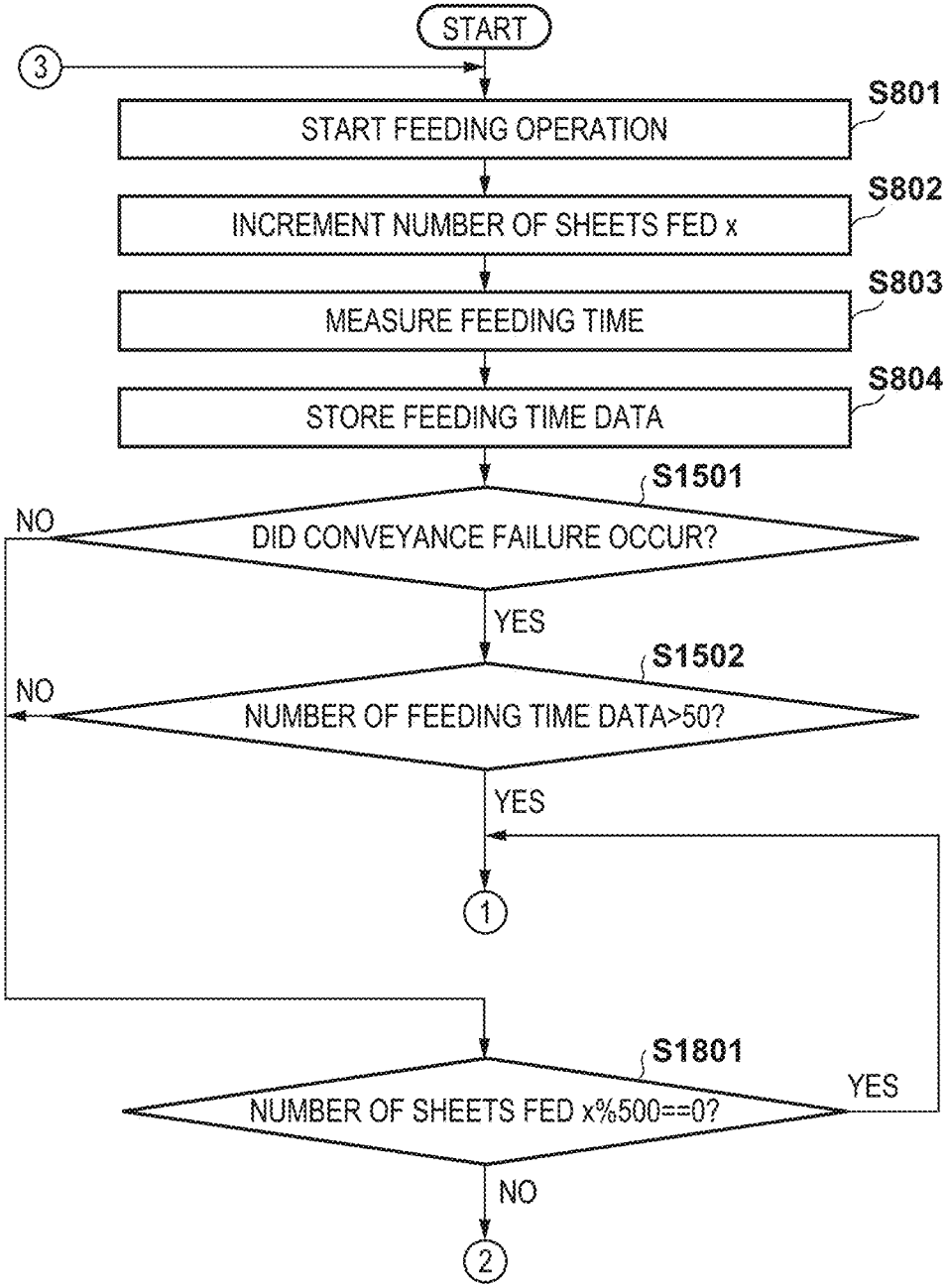
FIGS. 18A and 18B are a flowchart of the control unit according to the fifth embodiment.
Figure 18B:
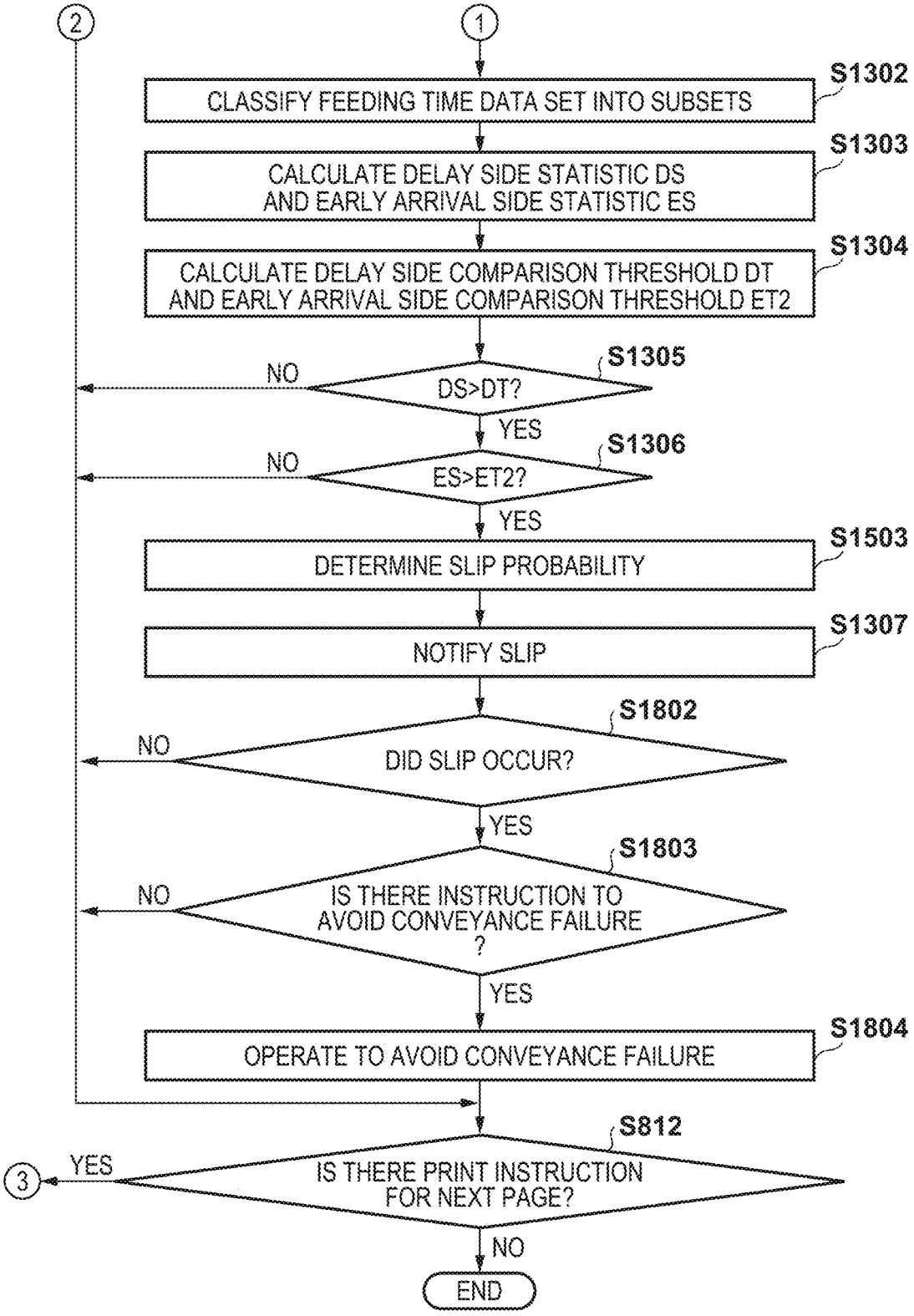

FIG. 18A and FIG. 18B is a flowchart describing processing for avoiding conveyance failure when it is determined whether slipping of the recording material is occurring in the image forming apparatus 100 according to the fifth embodiment. Note that in FIG. 18A and FIG. 18B, processing that is the same as that of the flowchart (FIG. 15) of the fourth embodiment described above is denoted by the same reference numerals, and description thereof is omitted.

In a case where there is no notification of conveyance failure in step S1501, the processing proceeds to step S1801 in which, similarly to step S1301 of the third embodiment, the computing device 412 functions as the slip determination unit 1201 to determine whether or not the number of sheets fed x is 500 sheets and whenever feeding time data of 500 sheets is stored, the processing proceeds to step S1302. In step S1302, the computing device 412 functions as the classification unit 511 to classify the feeding time data set stored in the RAM 424 into a delay side data set and an early arrival side data set. Next, in step S1303 to step S1304, the computing device 412 functions as the statistic calculation unit 512 to calculate the delay side statistic DS and the early arrival side statistic ES. In the fifth embodiment, DS=1550, DT=1469, t1=1426, ES=1290, ET2=1246, and t2=1186. Here, since DS>DT in step S1305 and ES>ET2 in step S1306, it is determined that a slip of the recording material has occurred, and the processing proceeds to step S1503.

In step S1503, the computing device 412 functions as the slip probability determination unit 1403 to calculate the slip probability. This method for calculating the slip probability is the same as that of the fourth embodiment, and since i=8.6 by Expression (7), according to FIG. 21C, the slip probability is 90%. Then, in step S1307, the computing device 412 functions as the notification unit 513 to notify the engine control unit 421 of the slip probability.

Next, the processing proceeds to step S1802 in which the CPU 422 functions as the conveyance failure avoidance control unit 1702 to determine that since the slip probability is 50% or more, slipping of the recording material is occurring, and proceeds to step S1803. In step S1803, the CPU 422 functions as the conveyance failure avoidance control unit 1702, to determine whether or not an instruction to avoid conveyance failure is received from the video controller 430. If so, the processing proceeds to step S1804 in which the CPU 422 switches to an operation to avoid conveyance failure.

The operation (suppression operation) to avoid conveyance failure is to perform an increase of contact pressure between the feeding roller 22 and the recording material S by the feeding pressure adjustment unit 1703 of (A) and change of time conveyance failure is detected by the conveyance failure determination unit 901 of (B) described above. Then, the processing proceeds to step S812, in which the CPU 422, if there is a print instruction for the next page, returns to start the feeding operation again in step S801, and otherwise, ends the processing.

As described above, according to the fifth embodiment, in a case where slipping of the recording material is occurring, the occurrence of conveyance failure of the recording material can be reduced by controlling so as to suppress the occurrence of the slipping. As a result, it is possible to reduce the effort of the user, such as the work of removing the recording material due to conveyance failure of the recording material.

Sixth Embodiment

The present embodiment is a combination of the first embodiment and the third embodiment. As described above, in the first embodiment, it is determined whether or not the positional misalignment of the trailing edge regulating plate 26 has occurred by the regulating plate misalignment determination unit 510, and in the third embodiment, it is determined whether or not slipping is occurring by the slip determination unit 1201. In the present embodiment, the server control unit 411 determines whether or not a positional misalignment of the trailing edge regulating plate 26 has occurred and further determines whether or not slipping is occurred. The description of the main parts is the same as that of the above-described first and third embodiments, and only parts that are different from the first and third embodiments will be described here.

Figure 22:
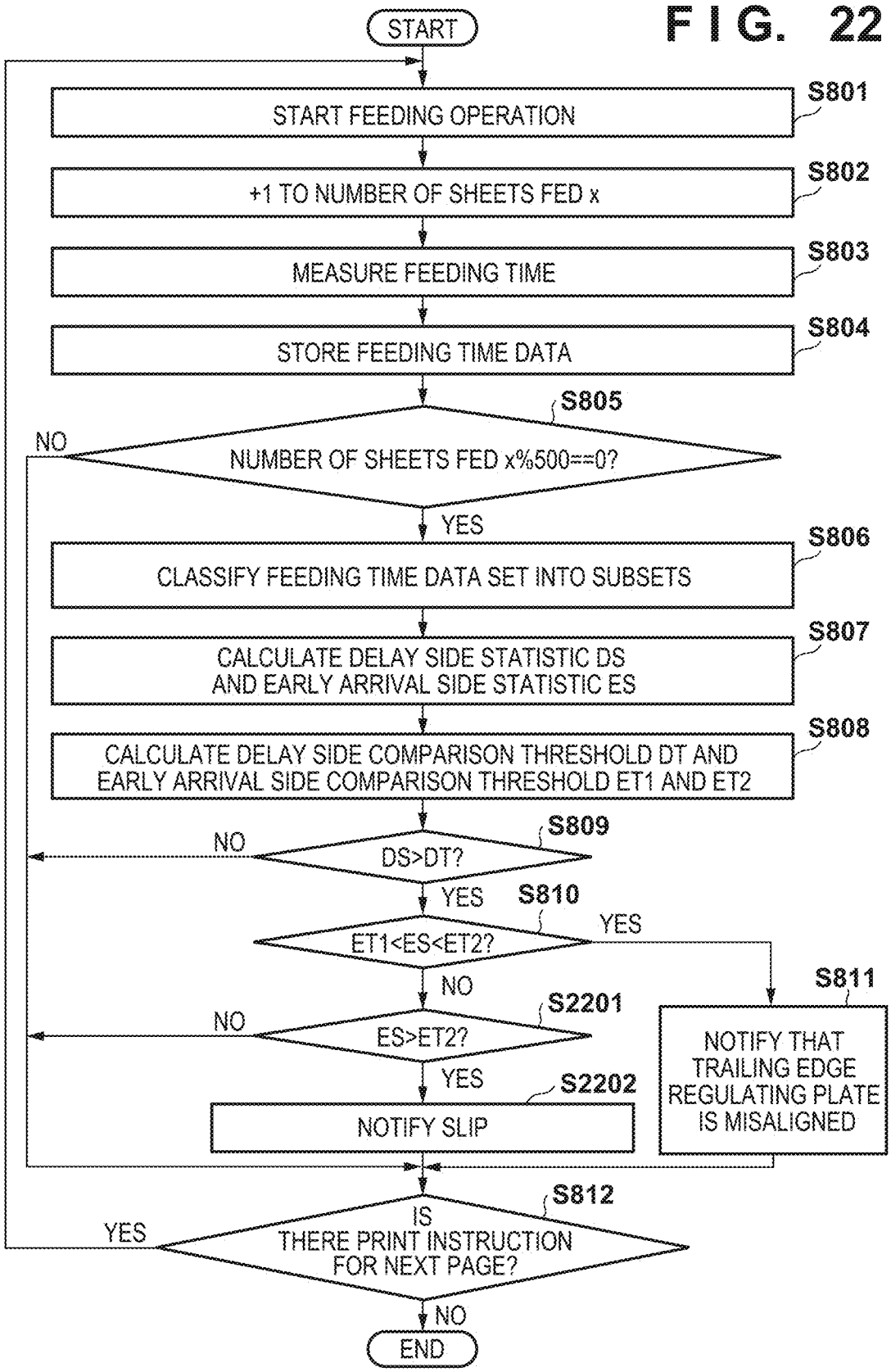
FIG. 22 is a flowchart of the control unit according to a sixth embodiment.

FIG. 22 is a flowchart describing processing for determining whether the trailing edge regulating plate 26 is misaligned and further determining whether slipping is occurring in the image forming apparatus 100 according to the sixth embodiment. Note that the processing indicated in this flowchart is realized by the CPU 422 executing a program deployed in the RAM 424 and working together with the server control unit 411. Note that in FIG. 22, processing that is the same as that of FIG. 8 of the first embodiment described above is denoted by the same reference numerals, and description thereof is omitted.

Description of processing in steps S801 to S812 is omitted. In the present embodiment, the computing device 412 determines whether or not ET1<ES<ET2 in step S810, and the processing after it is determined that is not the case is different to the first embodiment. If it is determined that (the early arrival side comparison threshold ET1<the early arrival side statistic ES<the early arrival side comparison threshold ET2) is not true, the computing device 412 proceeds to step S2201. If the early arrival side statistic ES>the early arrival side comparison threshold ET2, the processing proceeds to step S2202 in which the computing device 412 functions as the notification unit 513 to notify the engine control unit 421 that slipping of the recording material is occurring. That slipping of the recording material is occurring is displayed on the operation display unit 431 and notified to the host computer 400 of the user or dealer or a printer management tool (not shown). Then, finally, in step S812, the CPU 422 functions as the engine control unit 421 to determine whether or not there is a print instruction for the next page, and if there is, returns to "start feeding operation" in step S801 again, and otherwise, ends the control.

As described above, according to the sixth embodiment, it is possible to accurately detect and notify that the positional misalignment of the trailing edge regulating plate 26 has occurred or that slipping of the recording material is occurring. Also, it is possible to prompt the user or dealer to replace the recording material or the feeding roller before conveyance failure of the recording material occurs. In particular, by performing three steps S809, S810, and S2201 of the determination processing, it is possible to accurately determine whether the reason why the feeding of the recording material S takes a long time is due to the positional misalignment of the trailing edge regulating plate 26 or slipping.

Also, in the sixth embodiment described above, a method was described in which, before conveyance failure of a recording material occurs, the user or dealer is notified in advance that there is a positional misalignment of the trailing edge regulating plate 26 or that slipping is occurring. On the other hand, by combining the second embodiment and the fourth embodiment, in a case where conveyance failure of the recording material occurs, it may be determined whether the cause is a positional misalignment of the trailing edge regulating plate 26 or slipping of the recording material and then make a notification. Note that in the present embodiment, as in the above embodiments, the printer engine 420 may be configured to have the regulating plate misalignment determination unit 510 and the slip determination unit 1201. That is, configuration may be such that the processing is completed by the engine control unit 421 only without performing an exchange of information between the engine control unit 421 and the server control unit 411.

Other Embodiments

In the above embodiments, the feeding mechanism 20 has the feeding roller 22, the conveyance roller 23, and the separation roller 24. However, the present invention is not limited to this. For example, configuration may be such that one feeding roller that is larger in size than the feeding roller 22 is provided, and a first position of the surface of that feeding roller contacts the recording material S stored in the feeding cassette 21, and a second position of the surface of that feeding roller forms a separate nip unit with the separation roller 24. That is, according to this configuration, the conveyance roller 23 is not required.

In the above embodiments, the printer engine 420 or the video controller 430 sets the set position (reference position) of the trailing edge regulating plate 26 in accordance with the size of the recording material S stored in the feeding cassette 21. Here, configuration may be such that the size of the recording material S may be input by the user via the operation display unit 431 provided in the image forming apparatus 100. Alternatively, information related to the size of the recording material S may be included in the print job notified from the host computer 400.

Further, in the above embodiment, the count of the feeding time is started from the timing at which the feeding roller 22 starts feeding the recording material S, but the present invention is not limited to this. For example, a new sensor may be disposed at a position different from the conveyance path sensor 27 to start counting the feeding time from the timing when the recording material S is detected by the new sensor. Alternatively, the counting of the feeding time may be started from the timing at which the recording material S is detected by the conveyance path sensor 27 and ended at the timing at which the recording material S is detected by the new sensor.

The present invention may also be realized by processing in which a program for realizing one or more functions of embodiments described above is supplied to a system or device via a network or storage medium, and one or more processors in the computer of the system or device read and execute the program. Also, the present invention can be realized by a circuit (for example, ASIC) that realizes one or more functions.

The present invention is not limited to the embodiments described above, and various modifications and variations are possible without departing from the spirit and scope of the present invention. Therefore, to make the scope of the invention public, the following claims are appended.

According to the present invention, there is an effect that it is possible to determine the position of the regulating plate based on the conveyance state of the recording material.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-224025 filed on Dec. 11, 2019, and Japanese Patent Application No. 2020-196337 filed on Nov. 26, 2020, which are hereby incorporated by reference herein in their entirety.

What is claimed is:

1. An image forming system comprising: an information processing apparatus and an image forming apparatus, wherein the image forming apparatus comprises an accommodating tray configured to accommodate a recording material and having a regulating plate for regulating a trailing edge of the recording material in a feeding direction;

a feeding rotating member configured to feed the recording material accommodated in the accommodating tray;

a detection sensor configured to detect the recording material fed by the feeding rotating member;

one or more first hardware processors; and one or more first memories including first instructions, that when executed by the one or more first hardware processors, cause the image forming apparatus to function as:

a measuring unit configured to measure a time from a predetermined timing until the detection sensor detects the recording material, and the information processing apparatus comprises one or more second hardware processors; and one or more second memories including second instructions, that when executed by the one or more second hardware processors, cause the information processing apparatus to function as:

a reception unit configured to receive time data obtained by the measuring unit from the image forming apparatus;

a classification unit configured to classify a plurality of the time data received by the reception unit into a first group and a second group in accordance with a length of time; and a determination unit configured to determine, using the time data included in the first group and the time data included in the second group, whether or not a position of the regulating plate is misaligned in relation to a reference position which corresponds to a size of the recording material that is accommodated in the accommodating tray.

2. The image forming system according to claim 1, wherein the classification unit classifies the time data that is equal to or greater than a predetermined threshold value into the first group and classifies the time data that is smaller than the predetermined threshold value into the second group.

3. The image forming system according to claim 1, wherein the determination unit uses time data that is the n-th largest within the first group, where n is a predetermined number, and uses time data that corresponds to a median value within the second group.

4. The image forming system according to claim 1, wherein the determination unit, in a case where the time data included in the first group is larger than a first threshold value and the time data included in the second group is between a second threshold value that is smaller than the first threshold value and a third threshold value that is larger than the second threshold value and smaller than the first threshold value, determines that the regulating plate is misaligned from the reference position in a direction opposite to the feeding direction.

5. The image forming system according to claim 1, wherein the determination unit, using the time data included in the first group and the time data included in the second group, determines whether the position of the regulating plate is misaligned in relation to the reference position or recording material slipping is occurring due to the feeding rotating member.

6. The image forming system according to claim 5, wherein the determination unit, in a case where the time data included in the first group is larger than a first threshold value and the time data included in the second group is between a second threshold value that is smaller than the first threshold value and a third threshold value that is larger than the second threshold value and smaller than the first threshold value, determines that the regulating plate is misaligned from the reference position in a direction opposite to the feeding direction, and in a case where the time data included in the first group is larger than the first threshold value and the time data included in the second group is larger than the third threshold value, determines that the recording material slipping is occurring.

7. The image forming system according to claim 1, wherein, when conveyance failure of a recording material is detected by the detection sensor, the determination unit determines whether or not the position of the regulating plate is misaligned in relation to the reference position.

8. The image forming system according to claim 1, wherein the feeding rotating member includes a feeding member for feeding the recording material accommodated in the accommodating tray, a conveyance member for conveying the recording material fed by the feeding member, and a separation member that forms a separate nip unit with the conveyance member and is for separating one sheet from a plurality of recording materials.

9. The image forming system according to claim 1, wherein the measuring unit measures a time from a feeding start timing of the recording material by the feeding rotating member until the detection sensor detects the recording material.

10. The image forming system according to claim 1, wherein the first instructions, when executed by the one or more first hardware processors, cause the image forming apparatus to further function as:

a specification unit for specifying a size of the recording material accommodated in the accommodating tray, and wherein the reference position is set in accordance with the size of the recording material specified by the specification unit.

11. The image forming system according to claim 1, wherein the image forming apparatus comprises a display unit for displaying information, in which the display unit, in a case where the determination unit determines that the position of the regulating plate is misaligned, displays information indicating that the position of the regulating plate is misaligned.

12. An image forming system comprising: an information processing apparatus and an image forming apparatus, wherein the image forming apparatus comprises an accommodating tray configured to accommodate a recording material;

a feeding rotating member configured to feed the recording material accommodated in the accommodating tray;

a detection sensor configured to detect the recording material fed by the feeding rotating member;

one or more first hardware processors; and one or more first memories including first instructions, that when executed by the one or more first hardware processors, cause the image forming apparatus to function as:

a measuring unit configured to measure a time from a predetermined timing until the detection sensor detects the recording material, and the information processing apparatus comprises one or more second hardware processors; and one or more second memories including second instructions, that when executed by the one or more second hardware processors, cause the information processing apparatus to function as:

a reception unit configured to receive time data obtained by the measuring unit from the image forming apparatus;

a classification unit configured to classify a plurality of the time data that is received by the reception unit into a first group and a second group in accordance with a length of time; and a determination unit configured to, using the time data included in the first group and the time data included in the second group, determine whether recording material slipping is caused by the feeding rotating member.

13. The image forming system according to claim 12, wherein the classification unit classifies the time data that is equal to or greater than a predetermined threshold value into the first group and classifies the time data that is smaller than the predetermined threshold value into the second group.

14. The image forming system according to claim 12, wherein the determination unit uses time data that is the n-th largest within the first group, where n is a predetermined number, and uses time data that corresponds to a median value within the second group.

15. The image forming system according to claim 12, wherein the determination unit, in a case where the time data included in the first group is larger than a first threshold value and the time data included in the second group is larger than a third threshold value that is smaller than the first threshold value, determines that the slipping is occurring.

16. The image forming system according to claim 12, wherein the determination unit, in a case where conveyance failure of the recording material is detected by the detection sensor, determines whether recording material slipping is occurring.

17. The image forming system according to claim 12, wherein the image forming apparatus, in a case where the determination unit determines that recording material slipping is occurring, increases contact pressure between the feeding rotating member and the recording material accommodated on the accommodating tray.

18. The image forming system according to claim 12, wherein the image forming apparatus, in a case where the determination unit determines that recording material slipping is occurring, increases time until the detection sensor detects conveyance failure of the recording material.

19. An image forming apparatus, comprising:

an accommodating tray configured to accommodate a recording material and having a regulating plate regulating a trailing edge of the recording material in a feeding direction;

a feeding rotating member configured to feed the recording material accommodated in the accommodating tray;

a detection sensor configured to detect the recording material fed by the feeding rotating member; and one or more hardware processors; and one or more memories including instructions, that when executed by the one or more hardware processors, cause the image forming apparatus to function as:

a measuring unit configured to measure a time from a predetermined timing until the detection sensor detects the recording material, and a classification unit configured to classify a plurality of time data obtained by the measuring unit into a first group and a second group in accordance with a length of time; and a determination unit configured to determine, using the time data included in the first group and the time data included in the second group, whether or not a position of the regulating plate is misaligned in relation to a reference position which corresponds to a size of the recording material that is accommodated in the accommodating tray.

20. The image forming apparatus according to claim 19, wherein the determination unit, using the time data included in the first group and the time data included in the second group, determines whether the position of the regulating plate is misaligned in relation to the reference position or recording material slipping is occurring due to the feeding rotating member.

* * * * *